US009920917B1

(12) United States Patent
Isik et al.

(10) Patent No.: US 9,920,917 B1
(45) Date of Patent: Mar. 20, 2018

(54) HOUSE LIGHTING DEVICE

(71) Applicants: Tacettin Isik, San Jose, CA (US); Selcuk Sen, San Jose, CA (US)

(72) Inventors: Tacettin Isik, San Jose, CA (US); Selcuk Sen, San Jose, CA (US)

( * ) Notice: Subject to any disclaimer, the term of this patent is extended or adjusted under 35 U.S.C. 154(b) by 291 days.

(21) Appl. No.: 14/255,661

(22) Filed: Apr. 17, 2014

(51) Int. Cl.

| | |
|---|---|
| ***F21V 5/00*** | (2015.01) |
| ***F21V 23/04*** | (2006.01) |
| ***F21V 7/00*** | (2006.01) |
| *F21S 9/02* | (2006.01) |

(52) U.S. Cl.
CPC ..... *F21V 23/0464* (2013.01); *F21V 7/005* (2013.01); *F21V 7/0008* (2013.01); *F21S 9/02* (2013.01); *F21S 9/022* (2013.01)

(58) Field of Classification Search
CPC ..... F21S 9/02–9/022; F21V 7/005; F21V 7/0008
See application file for complete search history.

(56) References Cited

U.S. PATENT DOCUMENTS

| | | | | |
|---|---|---|---|---|
| 8,956,013 | B1 * | 2/2015 | Shew | F21S 9/022 362/183 |
| 2011/0211330 | A1 * | 9/2011 | Wang | F21S 4/28 362/20 |
| 2013/0235580 | A1 * | 9/2013 | Smith | F21V 13/04 362/235 |

* cited by examiner

*Primary Examiner* — Sean Gramling
(74) *Attorney, Agent, or Firm* — Law Office of Rodney LeRoy

(57) ABSTRACT

A house number light includes a frame defining an opening in a central portion and having a side opening along an inside face. The frame includes light sources, first and second power sources configured to provide electric power to the light sources, and a control circuit connected between the first power source and the light sources and connected between the second power source and the light sources. The control circuit electrically couples one of the first and the second power sources to the light sources at a time. If the first power source is electrically coupled to the light sources, electrical energy from the first power source passes through the control circuit to the light sources, and if the second power source is electrically coupled to the light sources, electrical energy provided by the second power source passes through the control circuit to the light sources.

20 Claims, 20 Drawing Sheets

HOUSE LIGHTING DEVICE

BACKGROUND OF THE INVENTION

The present invention generally relates to a lighting system, and more specifically relates to a house lighting device for lighting a house number that is positioned on a house.

House numbers that are positioned on houses typically follow a house number scheme that provides for unique house numbers to be assigned to houses on a street or in a given area. When house numbers are assigned by a government entity, the house numbers are often part of postal addresses. Local government entities, such as local city governments or local county governments, often assign house numbers to houses or plots of land on which the houses are located.

Physical house numbers are often positioned on a house to identify the house number assigned to the house. House numbers are typically positioned on a house with the intention of making it easier to identify and locate the house from easy viewing of the house numbers. A desire for easily viewing house numbers extends from family and acquaintances to private and government service providers, such as census takers, mail carriers, and emergency service providers who often need to accurately locate a house quickly so that emergency services can be provided.

To enhance the ease of viewing house numbers on houses, some government entities are requiring that house numbers be lighted. Some government entities are requiring both day and night lighting of house numbers to provide for easier viewing of house numbers at all hours of the day. House lighting devices that are designed for lighting house numbers in both day and night time lighting conditions can improve emergency response times for emergency service providers and allow others to easily and quickly locate houses by their posted and illuminated house numbers.

BRIEF SUMMARY OF THE INVENTION

According to one embodiment, a house number light includes a frame defining an opening in a central portion of the frame and having a side opening along an inside face of the frame facing the opening, and light sources positioned in the frame. The house number light further includes first and second power sources coupled to the frame, and a control circuit connected between the first power source and the light sources and connected between the second power source and the light sources. The control circuit is configured to electrically couple one of the first and the second power sources to the light sources at a time. If the first power source is electrically coupled to the light sources, electrical energy is provided by the first power source passes through the control circuit to the light sources and the second power source is electrically uncoupled from the light sources. If the second power source is electrically coupled to the light sources, electrical energy is provided by the second power source passes through the control circuit to the light sources and the first power source is electrically uncoupled from the light sources.

According to a specific embodiment, the side opening in the frame is transverse to the opening in the central portion of the frame. The frame comprises a mounting structure for mounting the frame to a surface, and wherein the surface has a visible identifier located on the surface. The opening in the central portion of the frame is configured to expose an identifier on a surface to which the frame is mounted. The identifier can be a house number.

According to another specific embodiment, the control circuit comprises: a first switch connected between the first power source and the light sources, a second switch connected between the second power source and the light sources, and an ambient light detector coupled to the first and the second switches and configured to switch the first switch and the second switch. The ambient light detector is configured to open the first and the second switches if the light detector detects an ambient light intensity above a threshold light level intensity. The second power source includes a set of rechargeable batteries. The control circuit comprises a battery charging circuit connected between the first power source and the second power source and is configured to receive electrical energy from the first power source and supply the electrical energy to the second power source for charging the rechargeable batteries in the second power source.

According to another specific embodiment, the control circuit comprises a light emitting diode (LED) driver connected between the first power source and the light sources and connected between the first power source and the battery charging circuit.

According to another specific embodiment, the house number light further includes a light diffusion element positioned in the side opening between the light sources and the opening in the central portion of the frame.

According to another specific embodiment, the house number light further includes a bar lens positioned in the side opening between the light sources and the opening in the central portion of the frame. The bar lens is configured to receive light generated by the light sources and direct the light through the opening in the central portion of the frame. The bar lens may have a triangular cross-section.

According to another specific embodiment, the frame is rectangular, and the opening in the central portion of the frame is rectangular.

According to another specific embodiment, the frame is ovoid, and the opening in the central portion of the frame is ovoid.

According to another specific embodiment, the frame comprises a reflector positioned on a front portion of the frame. The reflector is configured to reflect light generated by the light sources through the opening in the central portion of the frame.

According to another specific embodiment, the first power source is configured to receive house power from a house.

According to another specific embodiment, the frame comprises a top portion that houses the light sources and a bottom portion that houses the second power source.

According to another embodiment, a house number light includes a frame having a side opening along a first face of the frame; light sources positioned in the frame; first and second power sources coupled to the frame; and a control circuit connected between the first power source and the light sources and connected between the second power source and the light sources. The control circuit is configured to electrically couple one of the first and the second power sources to the light sources at a time. If the first power source is electrically coupled to the light sources, electrical energy is provided by the first power source passes through the control circuit to the light sources and the second power source is electrically uncoupled from the light sources. If the second power source is electrically coupled to the light sources, electrical energy is provided by the second power source passes through the control circuit to the light sources and the first power source is electrically uncoupled from the light sources.

According to another embodiment, a house number light includes a first post and a light bar that is electrically and mechanically coupled to the first post. The light bar includes one or more light sources. The house number light further includes a light shade mechanically coupled to the first post or the light bar. The house number light further includes first power source coupled to the first post, a second power source inside the first post. The house number light further includes a control circuit connected between the first power source and the light sources and connected between the second power source and the light sources. The control circuit is located within the first post and is configured to electrically couple one of the first and the second power sources to the light sources at a time. If the first power source is electrically coupled to the light sources, electrical energy is provided by the first power source passes through the control circuit to the light sources and the second power source is electrically uncoupled from the light sources. If the second power source is electrically coupled to the light sources, electrical energy is provided by the second power source passes through the control circuit to the light sources and the first power source is electrically uncoupled from the light sources.

According to a specific embodiment, the control circuit includes: (i) a first switch connected between the first power source and the light sources, (ii) a second switch connected between the second power source and the light sources, and (iii) an ambient light detector coupled to the first and the second switches and configured to switch the first switch and the second switch.

According to another specific embodiment, the ambient light detector is configured to open the first and the second switches if the light detector detects an ambient light intensity above a threshold light level intensity.

According to another specific embodiment, the second power source includes a set of rechargeable batteries.

According to another specific embodiment, the control circuit comprises a light emitting diode (LED) driver connected between the first power source and the light sources and connected between the first power source and the battery charging circuit. The LED driver includes: (i) a first diode (D1) is arranged in series electrically with the first and the second power sources, (ii) a first resistor (R1) is arranged in series with the first and the second power sources and is electronically positioned between D1 and the second power source, (iii) a second resistor (R2) is arranged in series with the light source, the first power source, and D1, and (iv) a second diode (D2) is arranged in parallel with the first power source, the second power source, and the light source. D1 is electronically positioned between R1 and the first power source, and R2 is electrically positioned between D1 and the light sources.

According to another embodiment, a house number light includes a first post and a light shade coupled to the first post. The house number light includes a reflector positioned within an extent of the light shade. The house light number includes a light source located with the extend of the light shade and adjacent to the reflector. The house light number includes first power source coupled to the light source, and a second power source coupled to the light source. The house light includes a control circuit connected between the first power source and the light sources and connected between the second power source and the light sources. The control circuit is configured to electrically couple one of the first and the second power sources to the light sources at a time. If the first power source is electrically coupled to the light sources, electrical energy is provided by the first power source passes through the control circuit to the light sources and the second power source is electrically uncoupled from the light sources. If the second power source is electrically coupled to the light sources, electrical energy is provided by the second power source passes through the control circuit to the light sources and the first power source is electrically uncoupled from the light sources.

According to one specific embodiment, the reflector is parabolic. The second power source and the control circuit may be positioned between a back of the reflector and the light shade.

According to another specific embodiment, the second power source includes a set of rechargeable batteries.

According to another specific embodiment, the house light number further includes a second post, wherein the light shade is rotationally coupled to the first post and the second post. The light shade, the first post, and the second post may have substantially rectangular shapes, substantially square shapes, rounded shapes (e.g., ovoid, circular, or other shapes), or other shapes.

According to another specific embodiment, the house lighting number further includes a second post mechanically coupled to the light bar.

DETAILED DESCRIPTION OF THE INVENTION

Figure 1A:
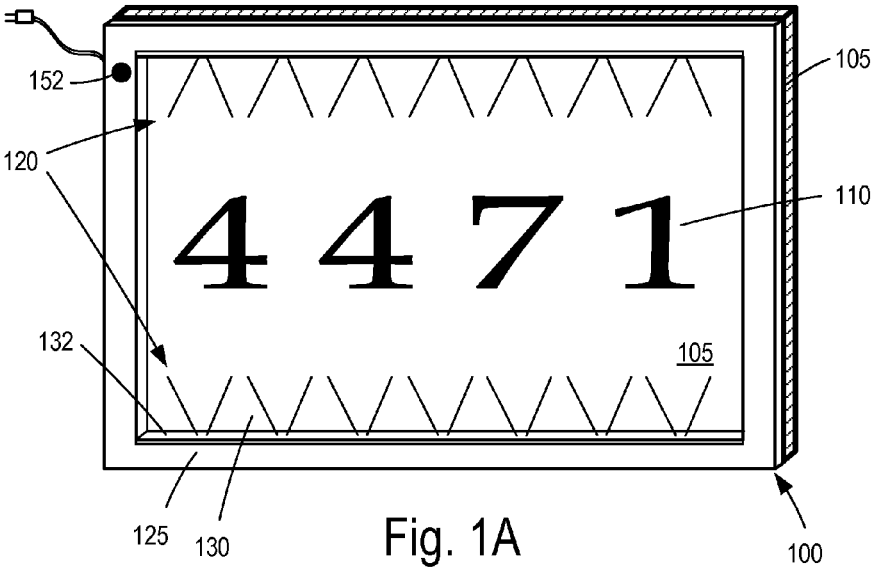
FIG. 1A shows a front view of a house lighting device attached to a surface of a house according to one embodiment.

FIG. 1A is a simplified front view of a house lighting device 100 attached to a surface 105 of a house according to one embodiment of the present invention. House lighting device 100 is configured to generate light 120 that is directed by the house lighting device toward a house number 110 of a house. The generated light is configured to illuminate the house number so that the house number is more clearly visible during one or both of daylight hours and nighttime hours.

Figure 1B:
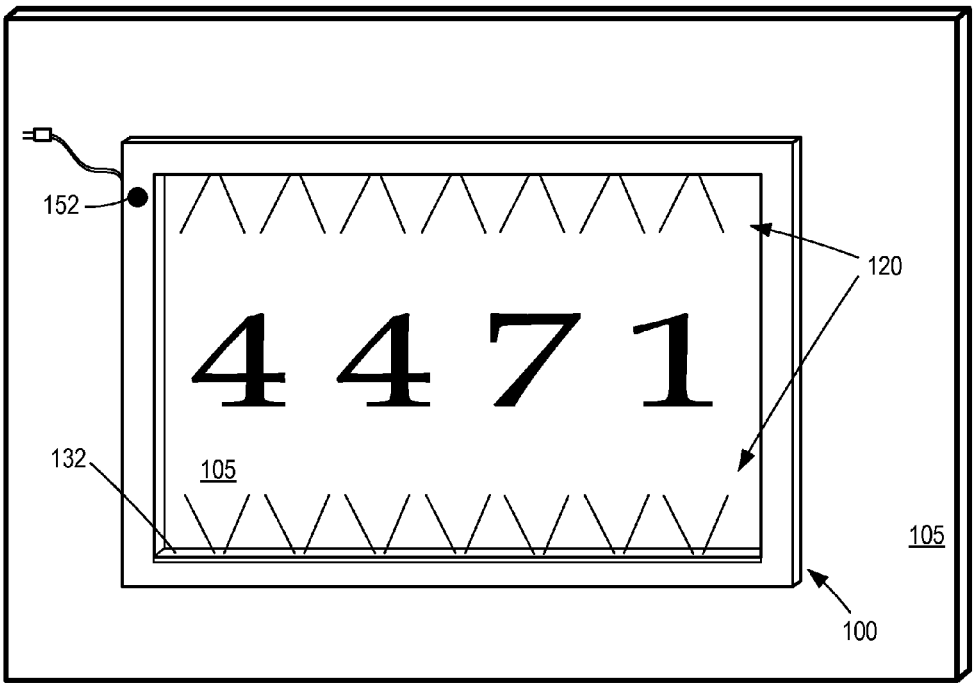
FIG. 1B shows a front view of a house lighting device attached to a surface of a house according to another embodiment.

Surface 105 can be an exterior wall (e.g., shown in FIG. 1B) of the house, a surrounding wall of a house (e.g., a wall separated from the house), a fence, a gate, a plant (such as a tree), a house number plaque that can include surface 105 (e.g., shown in FIG. 1A), a mail box, or other surface associated with a house. While house lighting device 100 is described as being configured for use with a house, the house lighting device can be attached to various types of buildings, such as office buildings, government buildings, apartment buildings, retail building, or other building types. In general, house lighting device can be attached to nearly any item (such as a fence, a wall, a tree, a power pole, or other surfaces) on which a house number can be posted to identify a house, a building, a business, a plot of land, or other structures or locations identified by a house number.

In one embodiment, house lighting device 100 includes a frame 125 that defines a central opening 130. The frame may be tube shaped (e.g., square, or rectangular cross-sectional tubing) formed from one or more of a variety of materials, such as plastic, metal (e.g., aluminum, anodized aluminum, painted tin, chromed tin, nickel plated tin, or other metal), nylon, or other materials. Opening 130 defined by frame 125 can have a variety of shapes, such as circular, ovoid, square, rectangular, or other shape. Frame 125 may have an overall shape that is complementary to the shape of opening 130, or may have an outer shape (e.g., rectangular) that is different from the shape (e.g., ovoid) of the opening.

Light generated by the house lighting device is directed through a side opening 132 in the frame toward opening 130, and a house number positioned in the opening can be illuminated by the generated light. The side opening 132 is transversely oriented with respect to opening 130 and permits light generated by the light sources to pass outward from the frame toward opening 130. The side opening may be formed in an inside wall of the frame where the inside wall faces opening 130. While the house lighting device is described as being configured to illuminate a house number, the house lighting device can be attached to a house for lighting other information, such as words or a combination of words and numbers that may identify the house.

Figure 2:
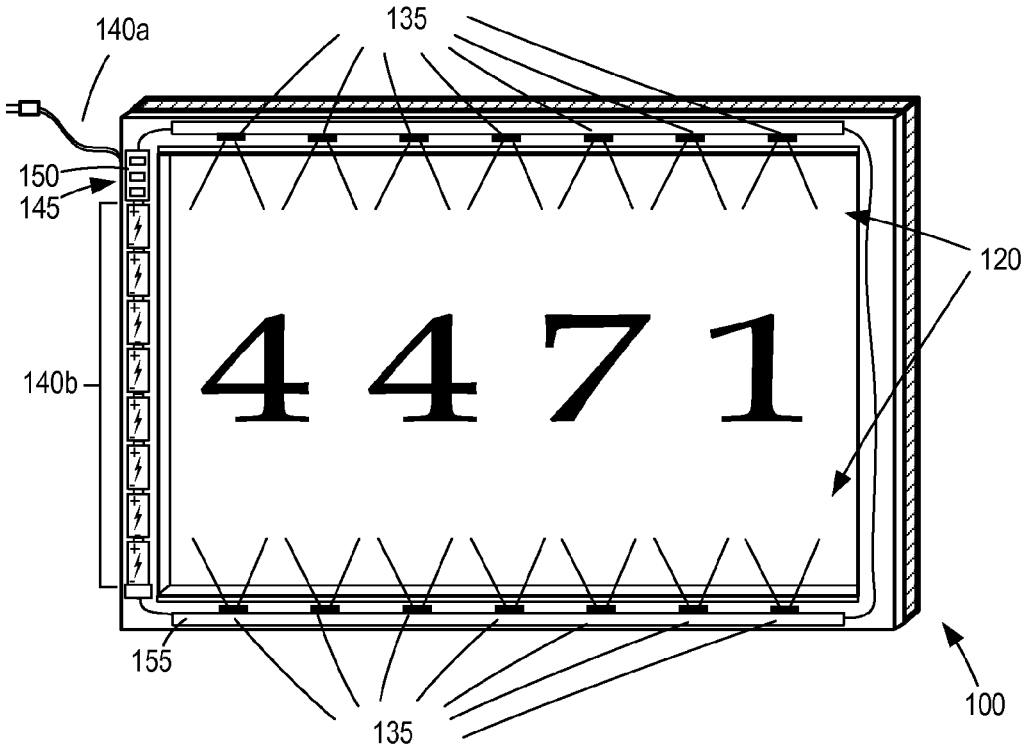
FIG. 2 shows a cutaway view of a front of the house lighting device shown in FIGS. 1A and 1B.

FIG. 2 is a cutaway view of a front of house lighting device 100 according to one embodiment and shows a number of components (e.g., internal components) of the house lighting device. In one embodiment, the components include one or more light sources 135 and one or more power sources (e.g., first and second power sources 140*a* and 140*b*) that provide electrical power to the light sources. In a further embodiment, the components include a circuit 145 that may be formed in part or in whole on a printed circuit board 150. Circuit 145 is configured to control a variety of functions of the house lighting device and is described in further detail below.

Turning now to light sources 135, the light sources may include one or more small incandescent lights, one or more fluorescent lights, one or more light emitting diodes (LEDs), one or more electroluminescent devices, or other types of light sources. In an embodiment where the light sources are LEDs, the LEDs may be discrete LEDs, surface mount LEDs, OLEDs, or other LED types.

The LEDs can be white light LEDs or can be configured to generate specific colors of light, such as orange light or yellow light. LEDs generating orange light or yellow light, for example, can quickly focus an emergency service provider's attention on the house numbers of a house because the orange or the yellow light may be a unique color of light emanating from the house and thereby can be quickly and easily located on the house.

Figure 3:
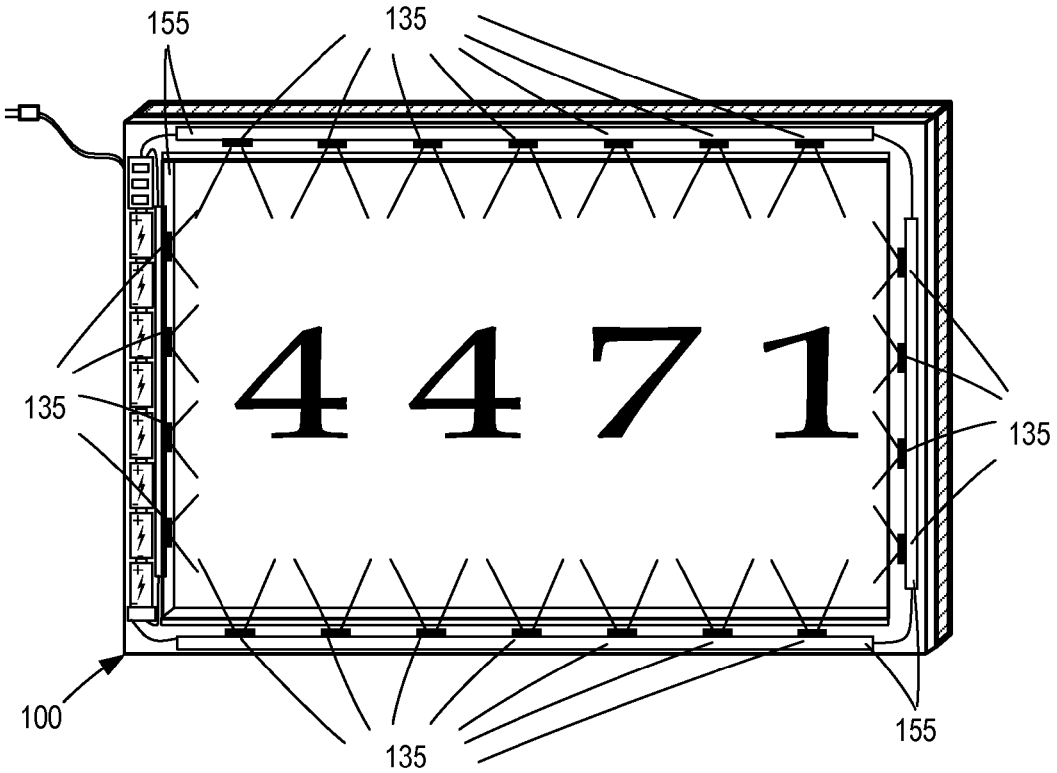
FIG. 3 shows an embodiment of the house lighting device where LEDs strips are positioned at the top, the bottom, and the sides of the house lighting device.

In one embodiment, the LEDs are mounted on one or more LED strips 155. Each LED strip can have one or more LEDs mounted on the strip. FIG. 2 shows an embodiment that includes two LED strips 155 where a number of LEDs on positioned the strips. The LED strips may be positioned in an interior portion or an exterior portion of frame 125 and may be positioned at a top and a bottom of the frame. According to one embodiment, the LEDs strips can be mounted at top and bottom portions of the frame as shown in FIG. 2 or in other locations in or on the frame. For example, FIG. 3 shows an embodiment of the house lighting device where LEDs strips are positioned at the top, the bottom, and the sides of the frame.

In some embodiments, the LED strips, the LEDs on the LEDs strips, or both are arranged in series electrically as shown in FIG. 2. In other implementations, the LEDs strips, the LEDs, or both are arranged electrically parallel. The LED strips or the LEDs might be arranged in parallel if the voltage drop across series arranged LEDs strips and LEDs becomes sufficiently large thereby inhibiting one or more of the LEDs from proper operation, which may include low light generation or no light generation.

The light sources (such as LEDs) may be configured to operate at one or more of a variety of voltages. For example, the light sources may operate at one or more of 1.5 volts, 3 volts, 6 volts, 9 volts, 12 volts, 15 volts, 18 volts, 21 volts, 24 volts, or higher voltages. The first power sources 140*a* and the second power source 140*b* are each configured to provide at least of one these operating voltages to the light sources based on the voltage at which the light sources are designed to operate.

In one embodiment, the first power source 140*a* is a wired power source configured to connect to a house power source and the second power source 140*b* is a battery power source. The first power source may be a default power source, and the second power source may be a backup power source that supplies electrical power to the light sources if the first power source fails. That is, if the house power source supplies electrical power to the first power source, then circuit 145 will electrically connect the first power source to the light sources so that electrical power from the first power source is directed to the light sources. In this situation, circuit 145 will also provide that the second power source is electrically disconnected from the light sources so that the second power source will not supply electrical power to the light sources. If the house power source fails to supply electrical power to the first power source, then circuit 145 may electrically connect the second power source to the light sources to provide that electrical power from the second power source is directed to the light sources. In this situation, circuit 145 will also provide that the first power source will be electrically disconnected from the light sources. For example, if power supplied to the house power source is interrupted during a storm that knocks out a power line and the house power source fails to supply electrical power to the first power source, then circuit 145 may direct the electrical power from the second power source to the light sources. Thereby, the house number of the house can remain illuminated during the house power interruption, and an emergency service provider, a power company, or other service providers can easily see the illuminated house number.

The second power source 140*b* may include one or more batteries that are electrically connected to the light sources through circuit 145. The batteries may be disposable batteries or rechargeable batteries. Disposable batteries are batteries that are discarded after discharge, and rechargeable batteries are batteries that can be recharged multiple times following multiple discharges. Some useful rechargeable battery chemistry technologies include nickel metal hydride (NiMH), nickel cadmium (NiCd), lithium ion (Li-ion), and zinc air. The batteries can provide sufficient power to power the light sources from a few minutes up to several hours, such as 2 hours, 4 hours, 6 hours, 8 hours, 10 hours, or longer.

In one embodiment, the batteries can be recharged via DC power provided to the batteries by the power source. In an alternative embodiment, the batteries can be removed from the frame and recharged by a user using a separate charger. In another alternative embodiment, circuit 145 includes one or more solar panels (not shown) that include one or more photovoltaic cells that can supply charging power to the batteries through the circuit. The solar panels may be coupled to the surface of frame 125 or mounted inside the frame with openings formed in the frame that permit external light to reach the solar panels.

Figure 4A:
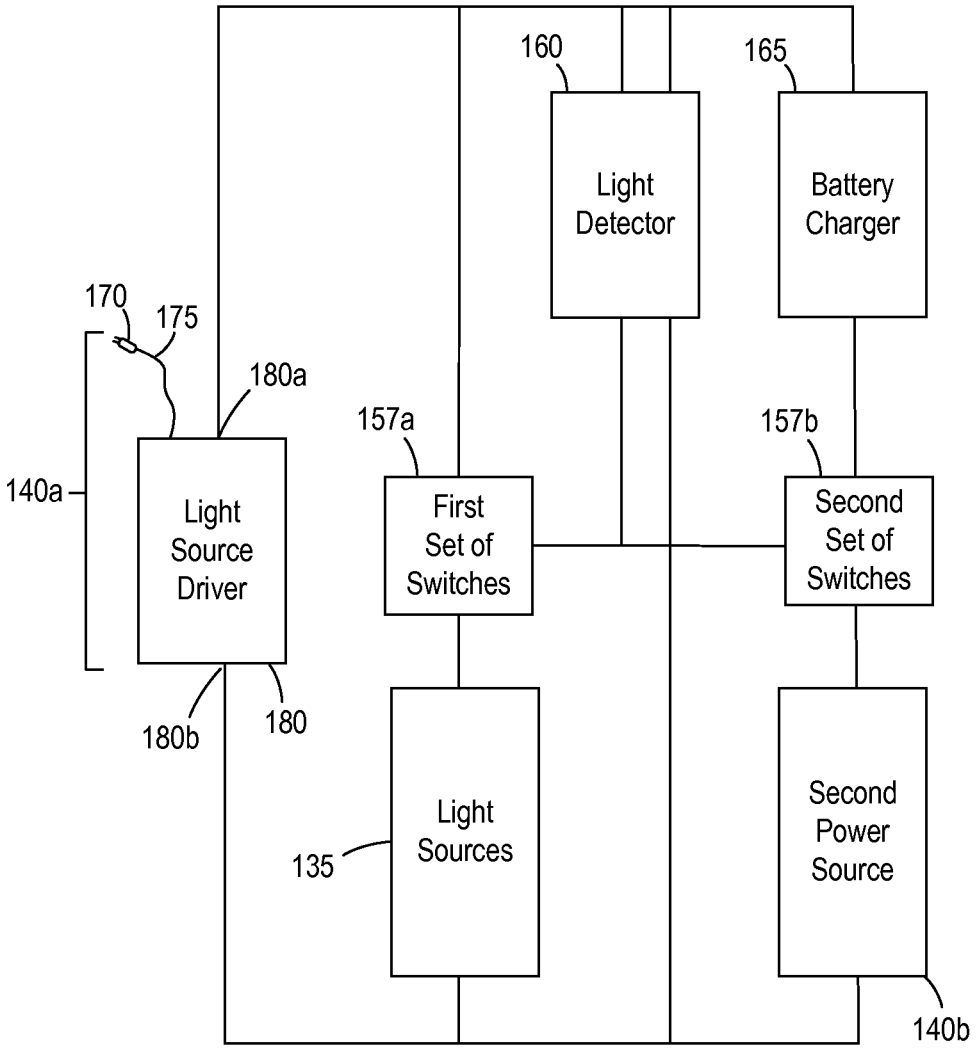
FIG. 4A shows a simplified schematic of a circuit included in the house lighting device according to one embodiment.

Turning now to circuit 145, FIG. 4A shows a simplified schematic of circuit 145 according to one embodiment. As shown in FIG. 4A, circuit 145 includes the first power source 140*a*, the second power source 140*b*, a first set of switches 157*a*, a second set of switches 157*b*, a light detector 160, and a battery charge circuit 165. Circuit 145 may include one or more of the foregoing listed circuit elements in any combination in various embodiments. For example, in a circuit embodiment where the second power source includes disposable batteries, the circuit might not include a battery charger. A set as describe herein includes one or more elements. For example, the first set of switches 157*a* can include one or more switches, and the second set of switches 155*b* can include one or more switches.

In one embodiment, first power source 140*a* includes a power connector 170, a power cord 175, and a light driver circuit 180. Power connector 170 is configured to connect to a power receptacle of a house and supply electrical power via power cord 175 to light driver circuit 180. Light driver circuit 180 may include an output current source 180*a* and a return current source 180*b*. The output current source 180*a* and the return current source 180*b* may be connected across light sources 135, across light detector 160, and across battery charge circuit 165 in combination with the second power source 140*b*. In embodiments where the light sources are LEDs, the light driver circuit is an LED driver. In embodiments where the light sources include one or more small fluorescent bulbs, the light driver circuit may include a ballast or the like for initially lighting the fluorescent bulbs.

As described briefly above, one of the first power source and the second power source is configured to supply power to the light sources at any given time. In one embodiment, the first set of switches and the second set of switches are configured to couple one of these power sources to the light sources at a time. For example, one or both of the first and the second set of switches may include power detectors that are configured to detect whether the first power source is receiving electrical power from the house. If the first power source is receiving electrical power from the house, then the first and second sets of switches may (i) connect the first power source to the light sources, (ii) disconnect the second power source from the light source, and (iii) connect the battery charging circuit to the second power source. If the first power source is not receiving electrical power from the house, then the first and second sets of switches may (i) disconnect the first power source from the light sources, (ii) connect the second power source to the light source, and (iii) disconnect the battery charging circuit from the second power source. In some embodiments, one or both of the first and the second set of switches include (i) one or more switches that perform these multiple switch function, (ii) multi-pole switches that perform these multiple switching functions, or (iii) a combination of these switch types.

The first and the second sets of switches may also be controlled by light detector 160. For example, if ambient light reaching the light detector is above a threshold intensity level, the light detector may configure the first and the second set of switches to disconnect the first and the second power supplies from the light sources. If the ambient light is at the threshold intensity level or below the threshold intensity level, then the light detector may configure the first or the second set of switches to connect the first or the second power source to the light sources as described immediately above. The threshold level may be a relatively low level of light, such as the light at dusk, or the light at dawn. The threshold level being relatively low provides that the house lighting device will begin illuminating a house number at dusk when ambient day light is low, will remain illuminated through the night, and will turn off and stop illuminating the house number at dawn when ambient light is increased.

The light detector can be mounted on a surface of frame 125, or frame 125 may have a relatively small aperture 152 (see FIGS. 1 and 2) formed in the frame that permits ambient light to reach the light detector. While the hole 152 is shown on a front face of the frame, the hole can be mounted on other surfaces of the frame, such as on a top surface.

In some embodiments, the threshold intensity level of the light detector is user programmable. For example, the threshold intensity level may be set to substantially zero so that the first or the second power source can supply electrical power to the light sources regardless of the ambient light level. Alternatively, the threshold intensity level may be set relatively high so that the first or the second power source power to the light sources at night when the ambient light level is relatively low. In some embodiments, the threshold intensity level of the light detected by the light detector may be set via a remote control device that is configured to wirelessly program the light detector. Various technologies can be used for wireless communication between a remote control and the light detector, such as bluetooth, WIFI or zigbee technologies. The light detector or other circuit element of circuit 145 may include a user accessible device, such as a knob, a set of switches or the like, for setting the threshold intensity level. The light detector can include one or more of a variety of light detecting devices, such as a photoresistor, a photodiode, a phototransistor, or other photodetector for detecting ambient light. In some embodiments, one or more of these light detectors may be positioned on a surface of the frame.

Figure 4B:
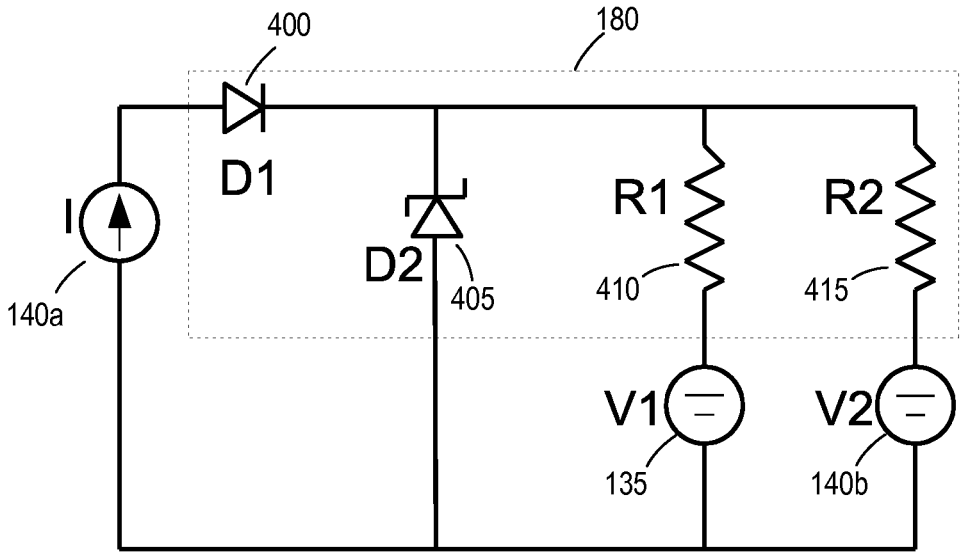
FIG. 4B shows a simplified schematic of an LED driver of the circuit shown in FIG. 4A according to one embodiment.

FIG. 4B is a circuit diagram of light driver circuit 180 (generally indicated within the dashed line FIG. 4*b*) according to one embodiment. The light driver circuit includes first and second diodes (D1 and D2) 400 and 405 and includes first and second resistors (R1 and R2) 410 and 415. D1 is arranged in series electrically with first and second power sources 140*a* and 140*b*. R1 is arranged in series electrically with the first and the second power sources 140*a* and 140*b* and is electrically positioned between D1 and the second power source 140*b*. D1 is also electrically positioned between R1 and first power source 140*a*. R2 is arranged in series electrically with light sources 135, first power source 140*a*, and D1. R2 is also electrically positioned between D1 and light sources 135. D2 is arranged in parallel electrically with first power source 140*a*, second power source 140*b*, and light sources 135. One or both of diodes 400 and 405 may be Zener diodes, regular diodes, or other types of diodes.

The light driver circuit is configured to direct electrical power to the light sources from one of the first power source and the second power source based on whether the first power source is receiving electrical power from the house. Specifically, if the first power source receives house power from the house, then the first power source provides electrical power to the light sources, and the second power source does not supply electrical power to the light sources. Also, if the first power source receives house power, then a portion of the electrical power is directed from the first power source to the second power source for charging the batteries of the second power source. In some embodiments, the electrical power directed to the second power source for charging the batteries is directed through a charging circuit that control the battery charging. If the house power drops out and the first power source cannot supply electrical power to the light sources, then the light driver circuit is configured to direct electrical power from the second power source to the light sources.

More specifically, if the first power source supplies electric power (e.g., current I from the first power source exists), then the batteries are charged until the voltage of the batteries equalizes to the voltage across the light sources (e.g., LEDs) plus the voltage drop across R1. That is, the battery charging stops if the voltage across the LEDs and R1 in combination equalizes with the voltage across the batteries. D2 inhibits the flow of electrical power backwards across the light sources and the batteries if electrical power is being supplied by the first power source. When electrical power from the first power source drops out, then the batteries discharges towards across the light sources, and D2 inhibits the flow of electrical power back into the first power source from the second power source.

The below set of Kirchoff equations (1) for the electronic junctions and electronic branches of the circuit loops of the light source driver (see FIG. 4B) provide for determining a set of condition for which the batteries of the second power source will charge, stop charging, and supply electrical power to the light sources. As described briefly above, I is the current provided by the first power source, and combined with D1, D2, R1, and R2 represents the light source driver for the Kirchoff equations with a compliance voltage determined by D2. In FIG. 4B and the following Kirchoff equations, V1 models the voltage drop across the light sources, and V2 models the voltage provided by the batteries in the second power source. After solving Kirchoff equations in DC, if V2 is changed with a capacitor, the resulting differential equation can be solved for $v_2(t)$ as shown in equation (6) below. As can be seen from equation (6), if I from the first power source is non-zero (i.e., the current exists and the first power source has not dropped out), the batteries are charged until the voltage of the batteries equalizes with the voltage across the light sources (e.g., LEDs) plus the voltage drop across R1. That is, if the voltage of the batteries equalizes with the voltage across the light sources plus the voltage drop across R1, then charging of the batteries stops. If electrical power (e.g., I) from the first power source drops out, then the batteries discharge across the light sources.

$$\begin{bmatrix} 1 & 1 \\ R_1 & -R_2 \end{bmatrix} \begin{bmatrix} I_{V1} \\ I_{V2} \end{bmatrix} = \begin{bmatrix} I \\ V_2 - V_1 \end{bmatrix} \tag{1}$$

The system of equations (1) above is solved for the current through the light sources and the current through the second power source resulting in equations (3) and (4) below.

$$\begin{bmatrix} I_{V1} \\ I_{V2} \end{bmatrix} = \frac{1}{-R_2 - R_1} \begin{bmatrix} -R_2 & -1 \\ -R_1 & 1 \end{bmatrix} \begin{bmatrix} I \\ V_2 - V_1 \end{bmatrix} \tag{2}$$

$$I_{V1} = \frac{1}{-R_2 - R_1}(-R_2 I + V_1 - V_2) \tag{3}$$

$$I_{V2} = \frac{1}{-R_2 - R_1}(-R_1 I - V_1 + V_2) \tag{4}$$

If the voltage for the second power source is replaced with a capacitor:

$$v_2(t) = \frac{1}{C}\int (i_{v2} dt) \tag{5}$$

and if equations (3) and (4) are set equal (i.e., if current $I_{V2}$ from the second power source is equal to the current $I_{V1}$), then the differential equation can be solved and $v_2$ (t) is determined to be:

$$v_2(t) = V_{20}\exp\left(\frac{-t}{C(R_1 + R_2)}\right) - R_1 I - V_1 \quad (6)$$

where $V_{20}$ is the initial value of $V_2$ of the batteries.

Turning again to the first and the second power sources, in one embodiment, power connector 170 is configured to receive a DC voltage from the house, such as 12 volts, 24 volts, or other voltage. The DC voltage can be provided from a house's voltage rectifier that can convert an AC voltage (e.g., 120 volts AC) to DC voltage (e.g., 24 volts DC). Such voltage rectifiers are often configured to provide 24 volts DC or other DC voltage to a house's door bells, smoke detectors, carbon monoxide detectors, or other appliances requiring 24 volts DC. Power connector 170 can be configured to receive the house DC voltage if the light sources (e.g., LEDs) are designed to operate on a DC voltage.

In one embodiment, light driver circuit 180 is connected between power connector 170 and light sources 135 and is configured to receive the house DC power from the power connector. The light driver circuit may include one or more DC-to-DC converters that convert the house DC voltage (e.g., 24 volts DC) to a second DC voltage (e.g., 12 volts) that the light sources (e.g., LEDs) are designed to use.

In another embodiment, the power connector and LED driver are configured to receive an AC voltage from the house, such as 120 volts AC. The LED driver may include a rectifier that converts the house AC voltage to a DC voltage usable by the light sources and other circuit elements of circuit 145.

The batteries of the second power source can be recharged, for example, via DC power provided by the light driver circuit 180 and battery charger circuit 165. The battery charger circuit may be configured to receive a DC voltage from the light driver and to monitor voltage across of the batteries. The battery charger circuit may control charging of the batteries based on a voltage output by the batteries. For example, the battery charger circuit may be configured to charge the batteries using one or more of a variety of charging algorithms, such as providing constant current for a first portion of a charging cycle until the batteries obtain a first amount of charge, and thereafter supply a constant voltage to top off the batteries to a substantially maximum charge. After the batteries reach a substantially maximum charge the battery charger may stop supplying the constant voltage to the batteries, and monitor the batteries for a voltage drop. The battery charger might monitor the voltage output by the batteries whether the batteries are used by circuit 145 for powering the light sources.

Figure 5:
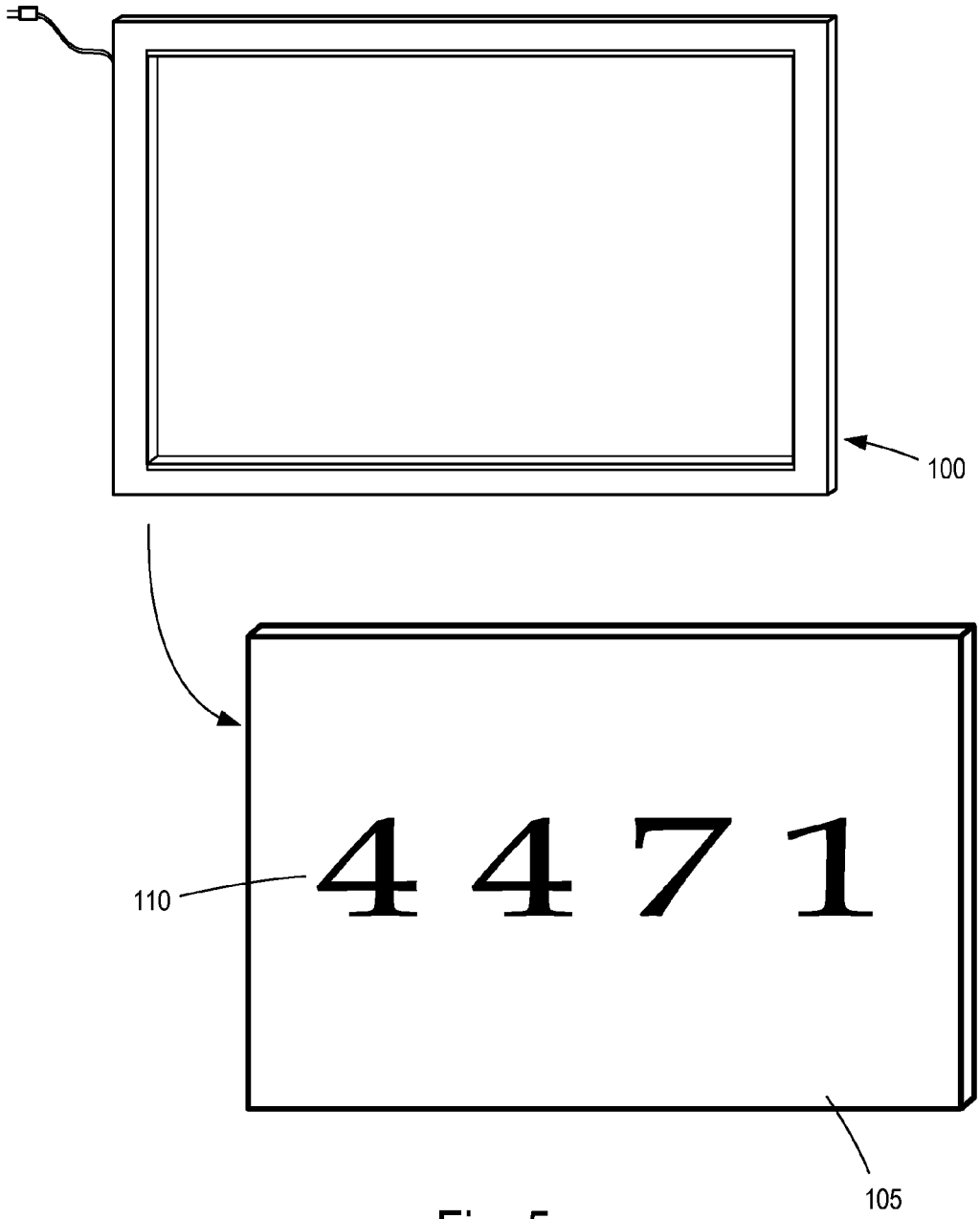
FIG. 5 shows a front view of the house lighting device separated from the surface of the house.

Referring to FIG. 5, this figure shows a front view of the house lighting device 100 separated from surface 105 and house number 110. House lighting device 100 can be attached to the surface by a variety of devices, such as screws, nails, detachable clamps, pins, adhesives, hook and loop fasteners, or other fasteners.

Figure 6:
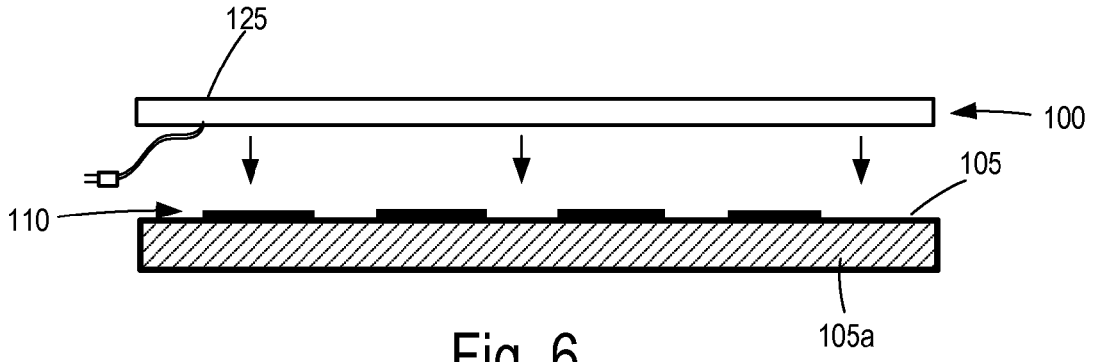
FIG. 6 shows a side view of the house lighting device separated from the surface of the house.
Figure 7:
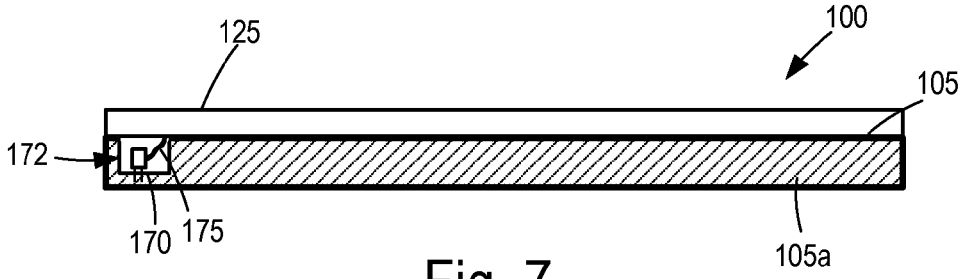
FIG. 7 shows the house lighting device attached to the surface of the house.

FIGS. 6 and 7 are side views of house lighting device 100. Specifically, FIG. 6 shows the house lighting device separated from surface 105 and house number 110, and FIG. 7 shows the house lighting device attached to the surface. FIGS. 6 and 7 represent a time series of events of the house lighting device being separate from the surface to being moved into contact with the surface.

Power connector 170 and power cord 175 can extend from the house lighting device along the surface, or may be configured to be routed through an opening in the surface to a power receptacle. FIG. 7 shows the power cord and power connector routed through surface 105 and connected to a power receptacle 172 located in wall 105*a*.

Figure 8:
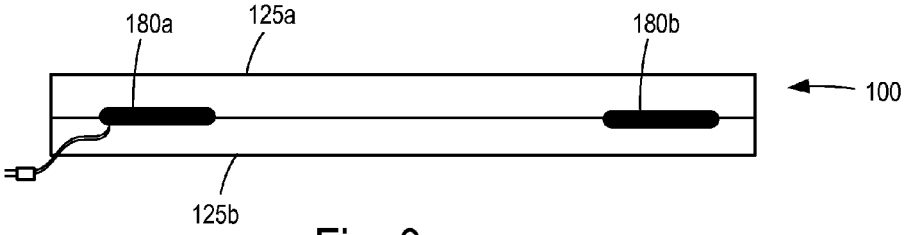
FIG. 8 shows a bottom side of the house lighting device.

FIG. 8 shows a view of the bottom side of the house lighting device according to one embodiment. In one embodiment shown, the bottom side of the house lighting device includes first and second hinges 180*a* and 180*b* that allows a top portion 125*a* of frame 125 to hinge open with respect to a bottom portion 125*b* of the frame. In other embodiments, frame 125 includes more or fewer than two hinges. In some alternative embodiments, the top portion and bottom portion are not hinge coupled and are separable without being hinge opened.

Figure 9:
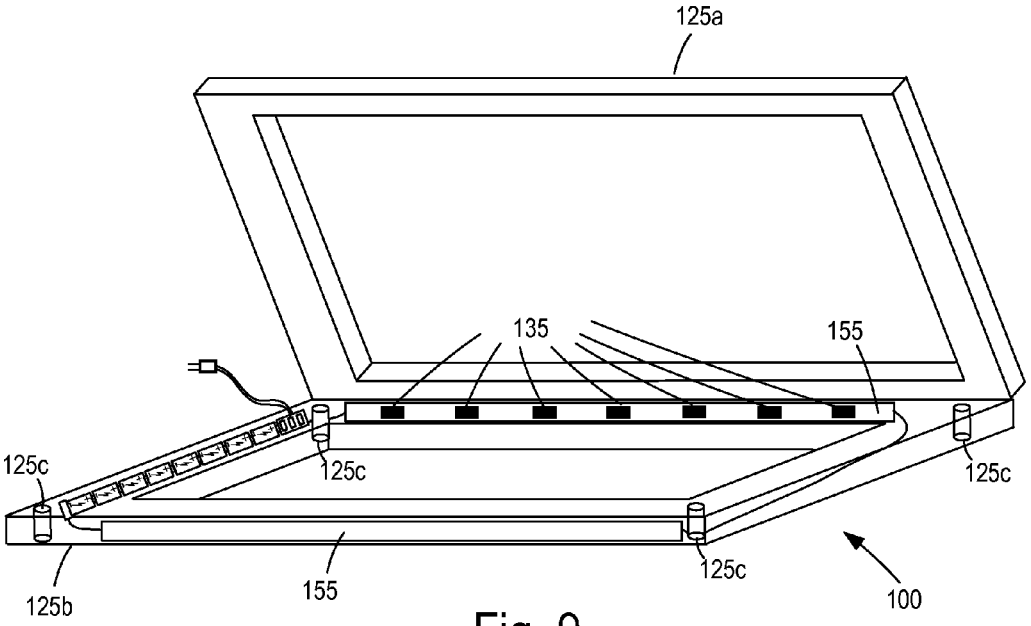
FIG. 9 shows the house lighting device with a top portion that is opened with respect to a bottom portion.

FIG. 9 shows an overall perspective view of top portion 125*a* of frame 125 hinge rotated (i.e., opened) with respect to bottom portion 125*b*. With the frame opened, access is provided to the internal components of the house lighting device, such as access for changing the batteries, changing the light sources, or servicing other components. With the top portion opened with respect to the bottom portion access is also be provided to fastener openings 125*c* formed on bottom portion 125*b*. The fastener openings are configured to receive fasteners, such as screws or nails, that can be used to secure the house lighting device to surface 105. While FIG. 9 shows the fastener apertures 125*c* formed in only the bottom portion 125*b* of the frame, in some embodiments the fastener apertures are also formed in the top portion 125*a*.

Figure 10:
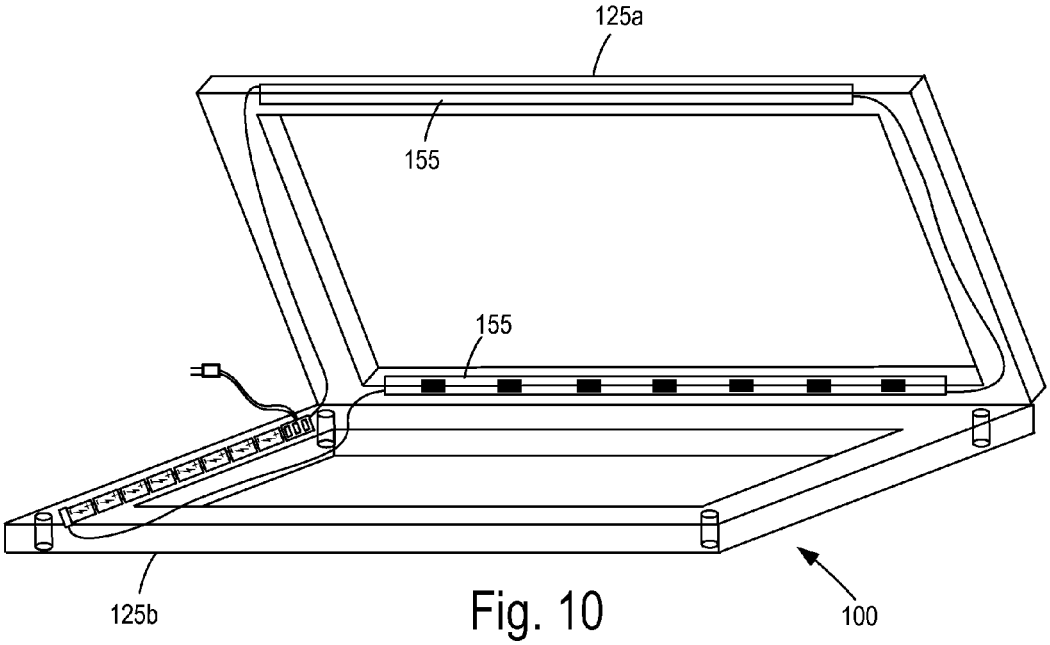
FIGS. 10 and 11 show LEDs strips positioned in the top portion of the frame.
Figure 11:
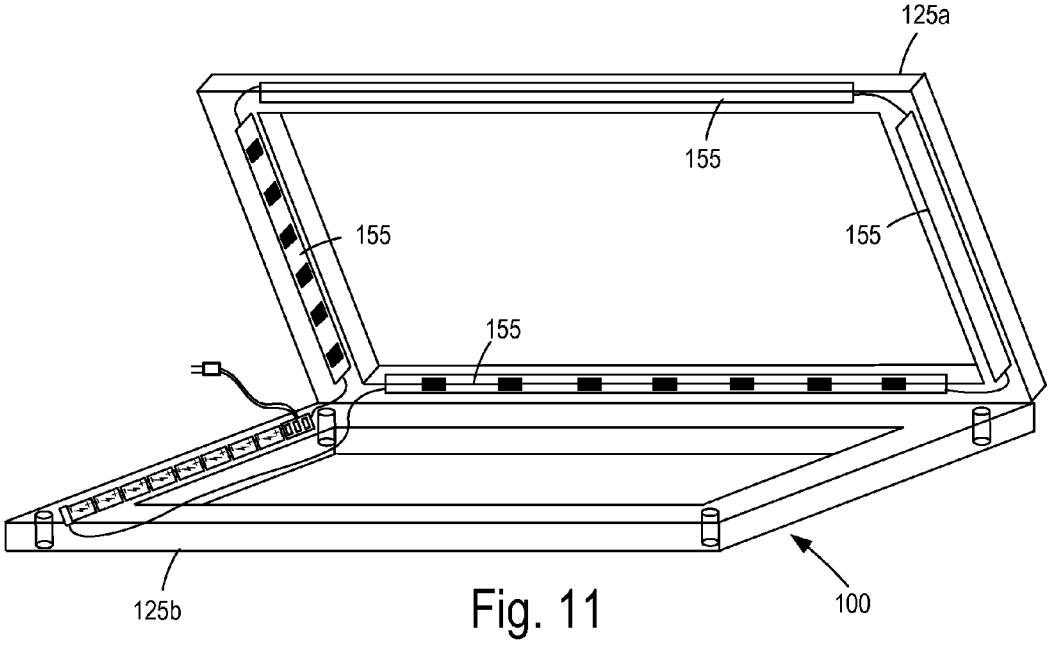

FIG. 9 further shows an embodiment where two LED strips 155 positioned in the bottom portion 125*b* of the frame. In alternative embodiments, the LEDs strips are positioned in the top portion 125*a* of the frame such as shown in FIGS. 10 and 11. In FIG. 10, the LEDs strips are show as being positioned at the top and bottom of the top portion 125*a*, and FIG. 11 shows the LEDs strips positioned at the top, the bottom, and the sides of the top portion.

Figure 12:
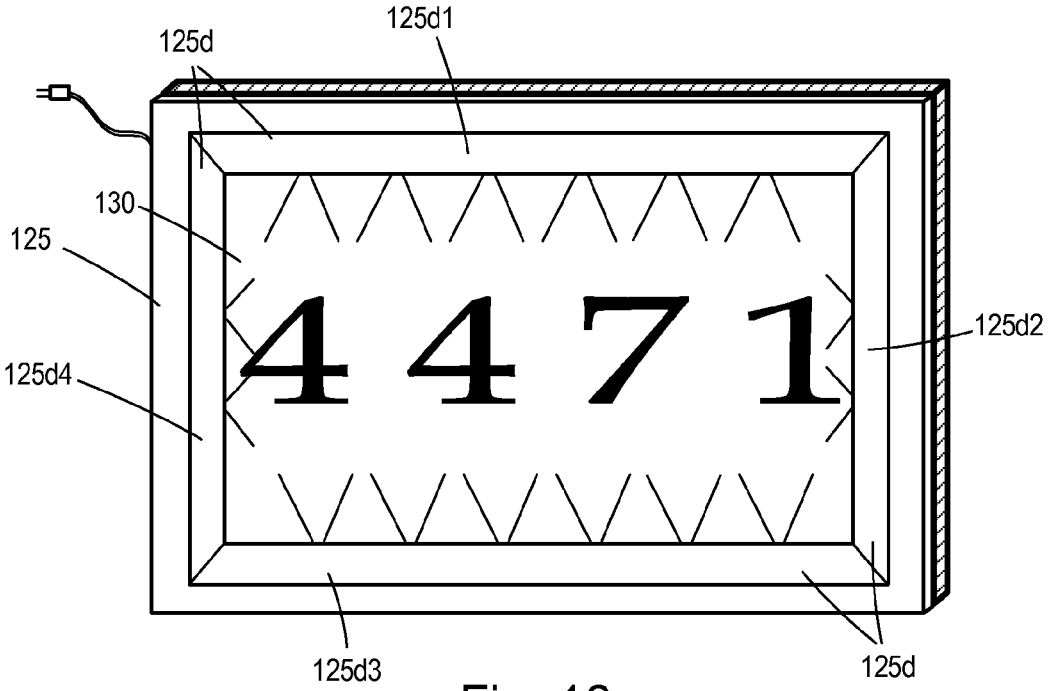
FIG. 12 shows a front view of the house lighting device according to an embodiment where the house lighting device includes a light reflector connected to a front surface of the frame.
Figure 13:
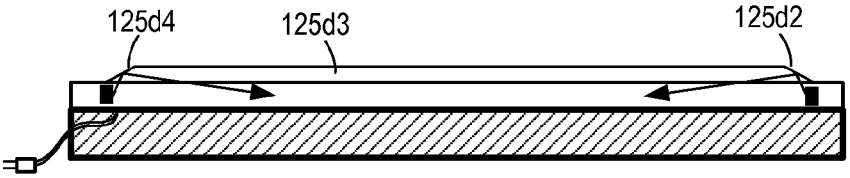
FIG. 13 shows a cutaway side view of the house lighting device with the light reflector attached to the front surface of the frame.

FIG. 12 is a front view of the house lighting device according to an embodiment where the house lighting device includes a light reflector 125*d* connected to frame 125. FIG. 13 is a cutaway side view of the house lighting device with the light reflector attached to the front surface of the frame. The light reflector extends upward from the front surface of the frame into opening 130. The light reflector may extend upward from the front surface into the opening at an angle between 0 degrees and 90 degrees (e.g., 25 degrees, 30 degrees, 35 degrees, 40 degrees, 45 degrees, or other angle) with respect to the front surface. The angle of the light reflector provides that light emitted from the light sources that strikes the light reflector will be reflected downward toward the house numbers. FIG. 13 shows left and right arrows that represent the path of light emitted from the light sources where the emitted light strikes the light reflector and is reflected downward toward the house numbers. The light reflector provides for a larger percentage of the emitted light to be directed toward the house numbers.

The light reflector may be formed from one or more of a variety of materials. For example, the light reflector may be formed of aluminum that is polished and coated, raw, anodized, chrome plated tin, nickel plated tin, or other metals. The light reflector may be formed of plastic or nylon that is chrome plated or plated with other highly reflective materials, such as polished nickel. Being plated with chrome, nickel, or other metal provides that the light reflector and the frame (described above) are not only functional but aesthetically attractive.

In the embodiment shown in FIG. 12, the light reflector is four sided and includes four deflector sections (labeled 125*d*1, 125*d*2, 125*d*3 and 125*d*4) that are positioned on the four sections (top, bottom, left, and right) of the frame. In alternative embodiments, the light reflector includes one or more the deflector sections. For example, if the house lighting device only includes light sources positioned along the top and the bottom the frame, then the light reflector might include top and bottom reflector sections 125*d*1 and 125*d*3 and might not include side reflector sections 125*d*2 and 125*d*4.

Figure 14:
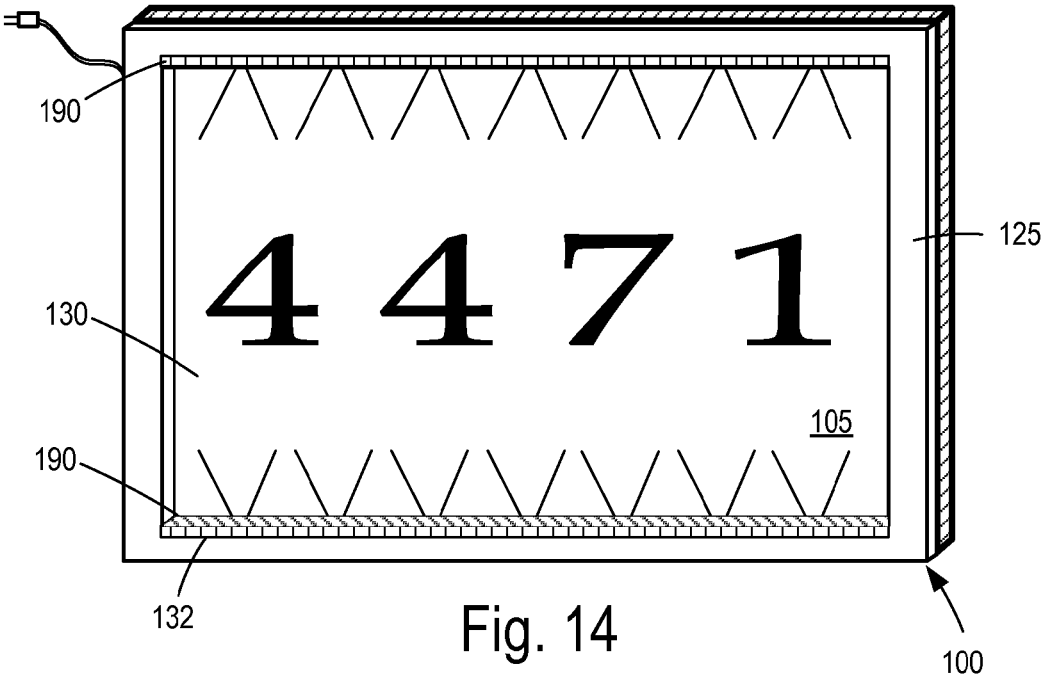
FIG. 14 shows a front view of the house lighting device where the frame includes one or more light diffusing elements.
Figure 15:
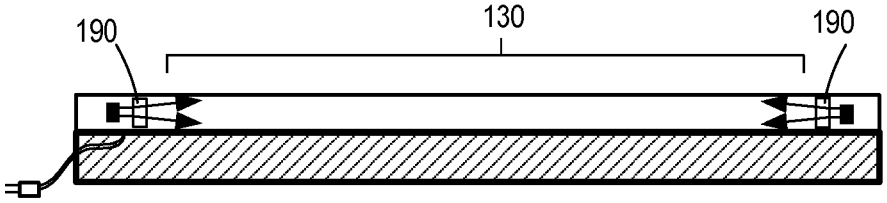
FIG. 15 shows a cutaway side view of the house lighting device where the house lighting device includes the light diffusing elements.

FIG. 14 is a front view of an embodiment of the house lighting device where frame 125 includes one or more light diffusing elements 190 positioned in side openings 132. FIG. 15 is a cutaway side view of the house lighting device where the house lighting device includes the light diffusing elements. The cutaway view of the frame in FIG. 15 shows the ends of the light diffusing elements.

The light diffusing elements are positioned between the light sources 135 and the opening 130 of the frame. In some embodiments, the light diffusing elements extend beyond the frame into opening 130. In other embodiments the light diffusing elements are co-extensive with the frame, or within the frame with surfaces that are directed toward the opening of the frame. In the embodiment shown in FIG. 14, the light diffusing elements are shown as extending into opening 130, and in FIG. 15 the light diffusing elements are shown as being positioned within the frame and not extending into opening 130. The light diffusing elements are configured to receive light from light source 130 and diffuse the light into opening 130 for substantially evenly illuminating the house number. While FIGS. 14 and 15 show two light diffusion elements positioned at the top and the bottom of the frame, the light diffusing elements may be arranged in alternative configurations, such as at the sides, at the top and the sides, at the top, at the bottom and the sides, or in other configurations.

Figure 16:
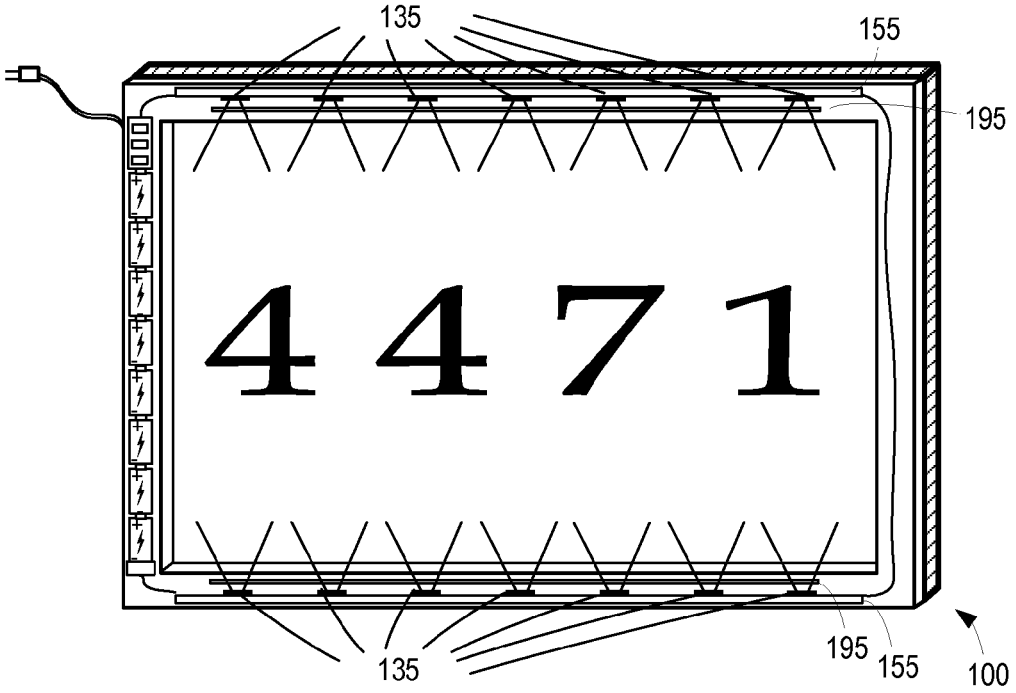
FIG. 16 shows a cutaway front view of the house lighting device where the frame includes one or more lenses.
Figure 17:
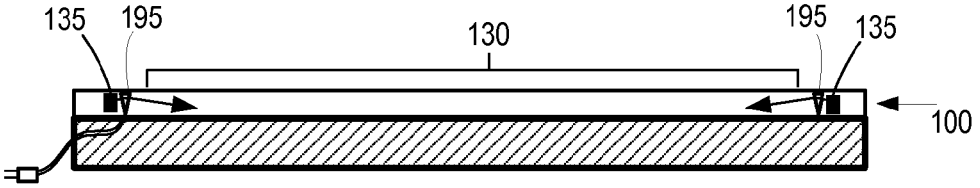
FIG. 17 shows a cutaway side view of the house lighting device where the house lighting device includes the lenses.

FIG. 16 is a front cutaway view of an embodiment of the house lighting device where frame 125 includes one or more lenses 195. FIG. 17 is a side cutaway view of the house lighting device where the house lighting device includes the lenses. The lenses may be bar lenses that extend along lengths of the frame. The lenses are positioned between the light sources 135 and the opening 130 of the frame. The lenses receive light from the light sources and direct the light toward the house numbers. The lenses may have a variety of shapes for directing received light toward the house numbers. For example, the lenses may have one or more concave, convex, or planar surfaces. In the embodiment shown in FIG. 17, each of the lenses has a triangular cross-section (e.g., substantially prismatic in shape). The lenses may be plastic, glass, or other material that has an appropriate refractive index for directing the received light as described. The frame may include one or more lenses variously positioned in the frame, such as along the top, along the bottom, along the top and the bottom, along the sides, or in other configurations. In some embodiments, one or more faces (e.g., the exiting faces) of the lenses may be diffusive surfaces that diffuse light exiting the lenses.

Figure 18:
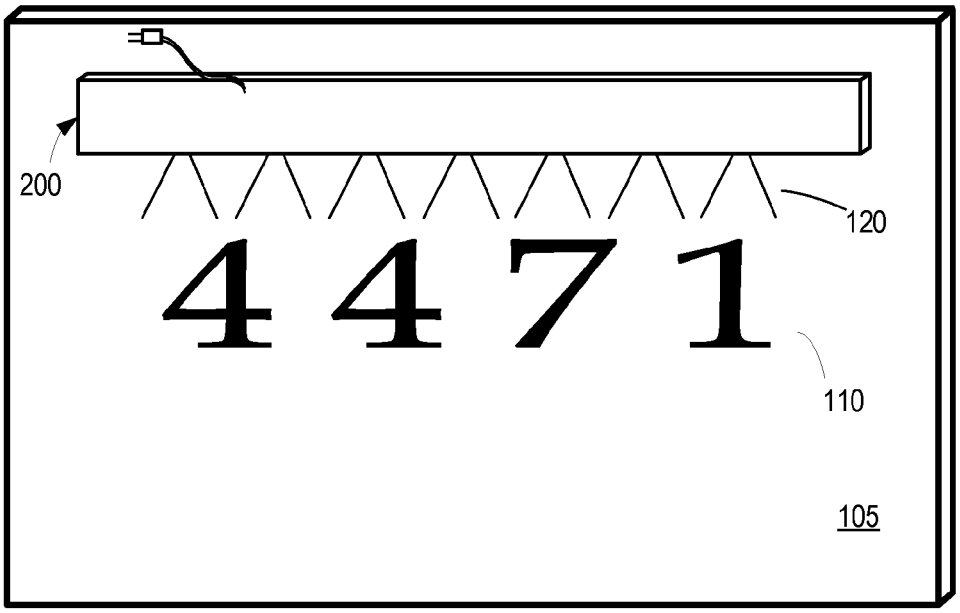
FIG. 18 shows a front view of a house lighting device according to an alternative embodiment.
Figure 19:
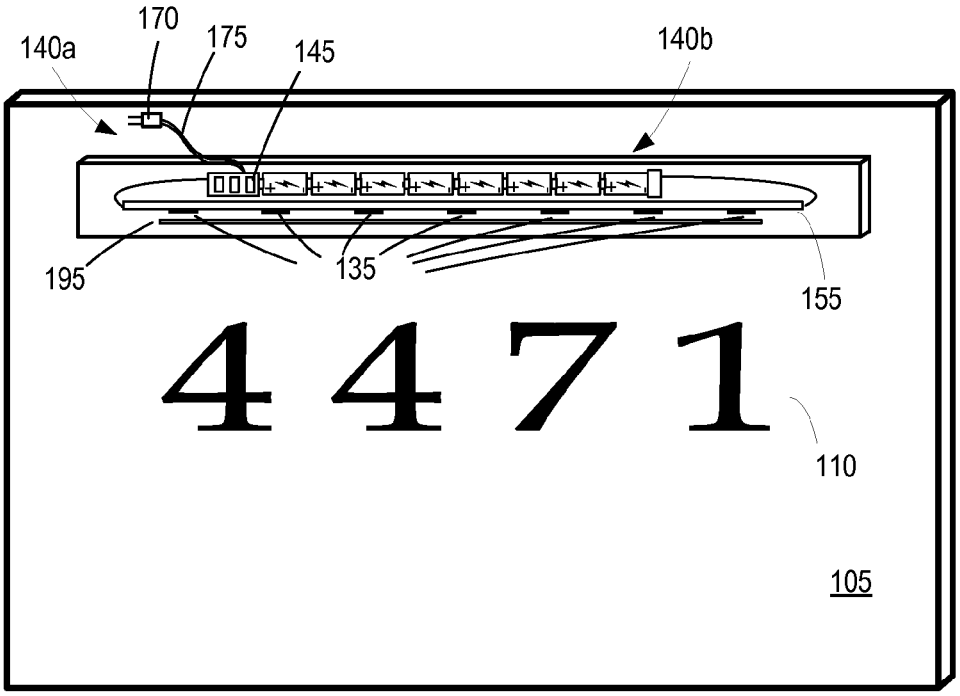
FIG. 19 is a cutaway view of the house lighting device that is shown in FIG. 18.

FIG. 18 is a front view of a house lighting device 200 according to an alternative embodiment, and FIG. 19 is a cutaway view of the house lighting device. House lighting device 200 is substantially similar to house lighting device 100 described above expect that house lighting 200 includes a frame 225 that is composed of a single frame element. Frame 225 includes substantially the same internal components as frame 125 in that frame 225 may includes one or more light sources 135, a lighting strip 155 (e.g., an LED strip), circuit 145, first power source 140*a*, and second power source 140*b*. House lighting device 200 may further include one or both of light diffusing element 190 and lens 195. House lighting device 200 may also include a reflecting device 125*d*. Similar to frame 125, frame 225 may include one or more of these elements in various combinations. While frame 225 is shown in FIGS. 18 and 19 and being positioned above the house number, the frame can be positioned below the house number or to the side of the house number. In some usage embodiments, two or more house lighting devices 225 can be used to illuminate a house number. For example, one house lighting device 225 can be positioned above the house number and one house lighting device 2200 can be positioned below the house number.

Figure 20:
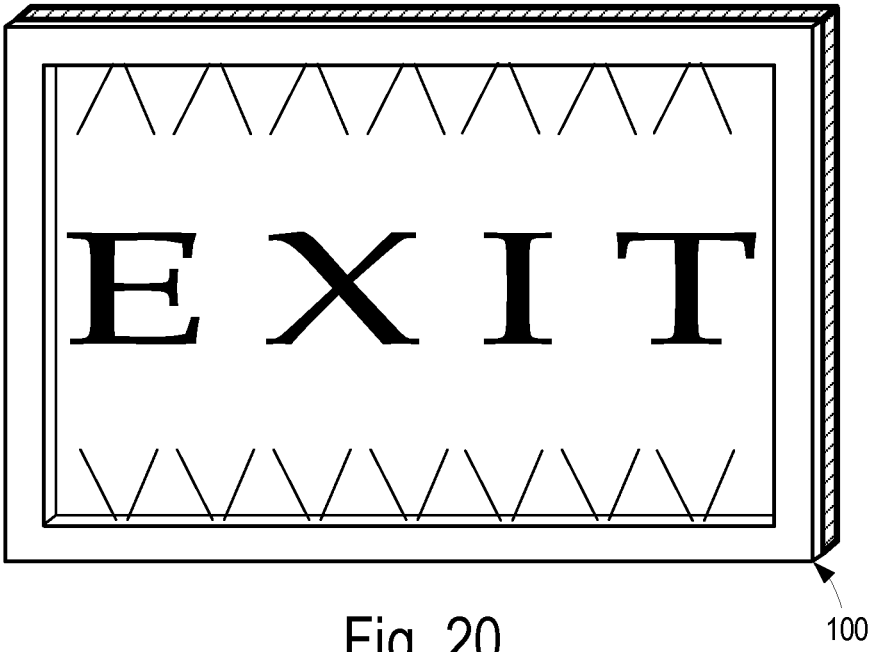
FIG. 20 shows an embodiment of house lighting device 100 positioned around an exit sign.
Figure 21:
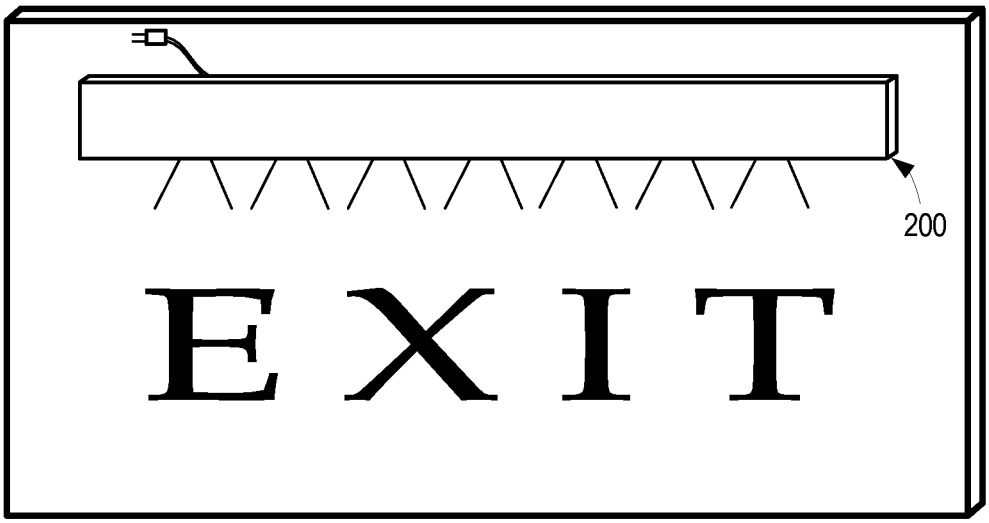
FIG. 21 shows an embodiment of house lighting device 200 positioned above an exit sign.

Is some use embodiments, house lighting devices 100 and 200 can be poisoned by exit signs or other signs for illuminating these signs. For example, a house lighting device 100 can be positioned around a lighted exit sign as shown in FIG. 20 to provide extra illumination for easy viewing, or may be positioned around a non-lighted exit sign to illuminate the exit sign in low light situations. FIG. 21 shows an embodiment of house lighting device 200 positioned above an exit sign.

Figure 22:
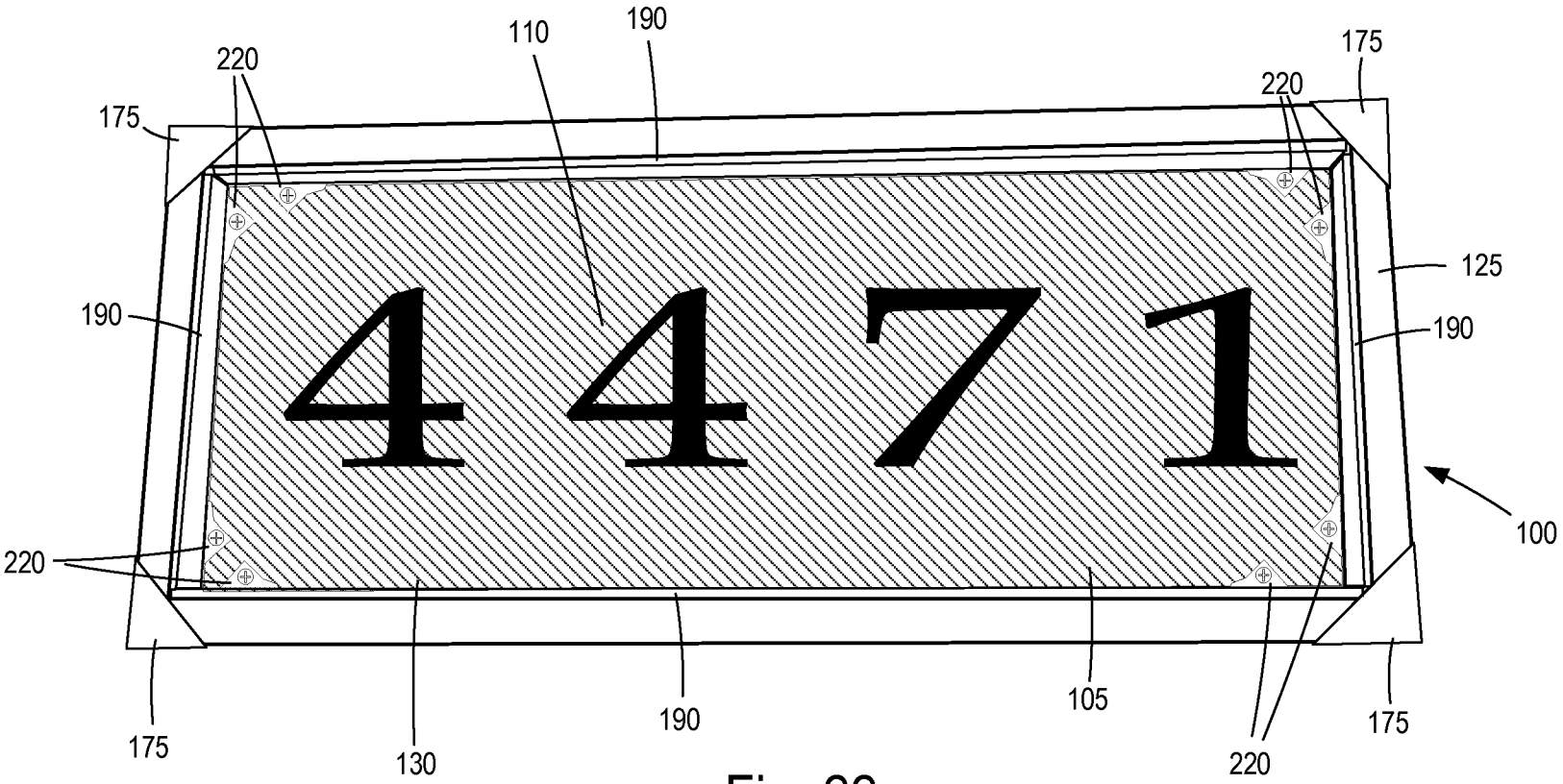
FIG. 22 is an image of a specific embodiment of house lighting device connected to a house number plague.

FIG. 22 is an image of a specific embodiment of house lighting device 100 connected to a house number plague having a house number attached to the house number plaque. The house number plaque is configured to be attached to house or other building. The images shows a number of diffusing elements 190 configured to diffuse light from the light sources positioned in frame 125. The image further shows an alternative mounting device 220 configured to accept fasteners, such as screws, for attaching the house lighting device to the house number plaque. According to the embodiment shown in FIG. 22, the frame elements (top, bottom, and sides) composing the frame have reinforcing connection members 225 that add extra structural integrity for holding the frame members together.

FIG. 22 is an image of a specific embodiment of house lighting device 100 connected to a house number plague having a house number attached to the house number plaque. The house number plaque is configured to be attached to house or other building. The images shows a number of diffusing elements 190 configured to diffuse light from the light sources positioned in frame 125. The image further shows an alternative mounting device 220 configured to accept fasteners, such as screws, for attaching the house lighting device to the house number plaque. According to the embodiment shown in FIG. 22, the frame elements (top, bottom, and sides) composing the frame have reinforcing connection members 225 that add extra structural integrity for holding the frame members together.

Figure 23:
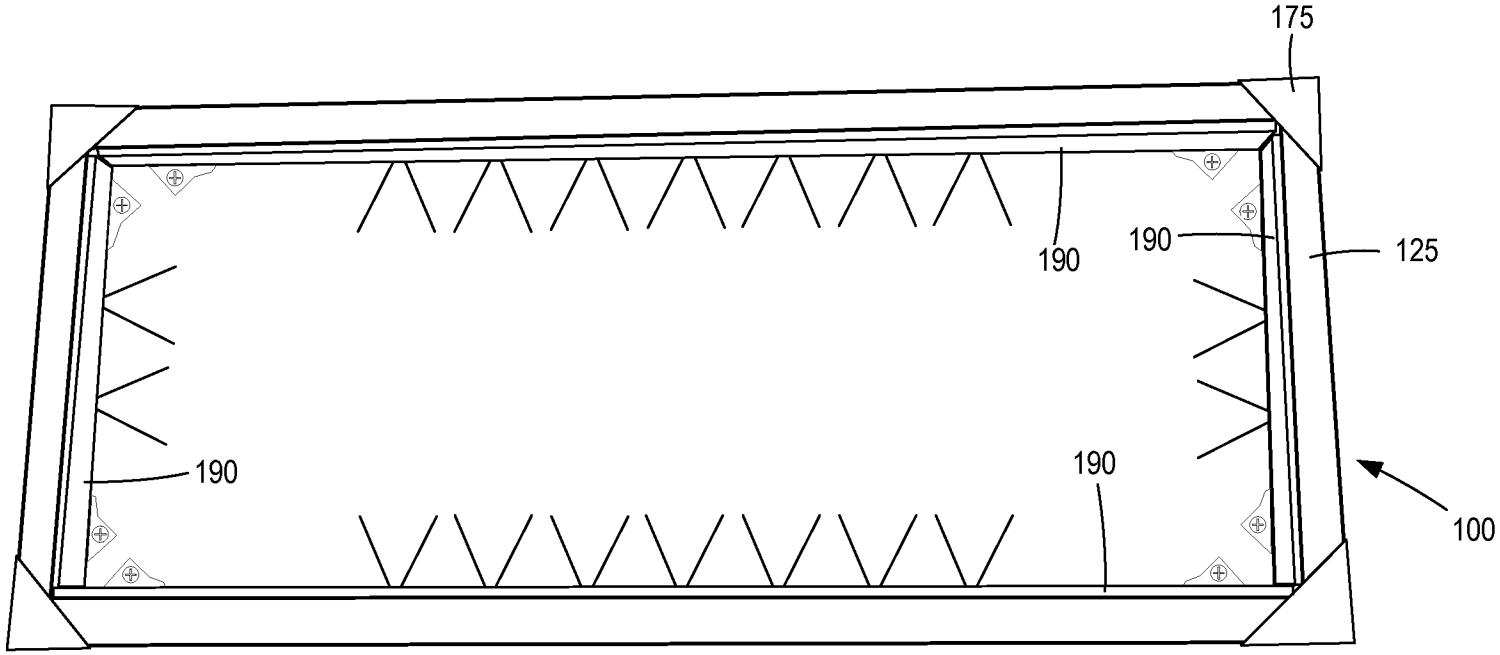
FIG. 23 is an image of a specific embodiment of house lighting device disconnected from any house or house number plaque.

FIG. 23 is an image of a specific embodiment of house lighting device 100 disconnected from any house or house number plaque. The image shows the house lighting device generating light that is diffused through the diffusing elements 190.

Figure 24:
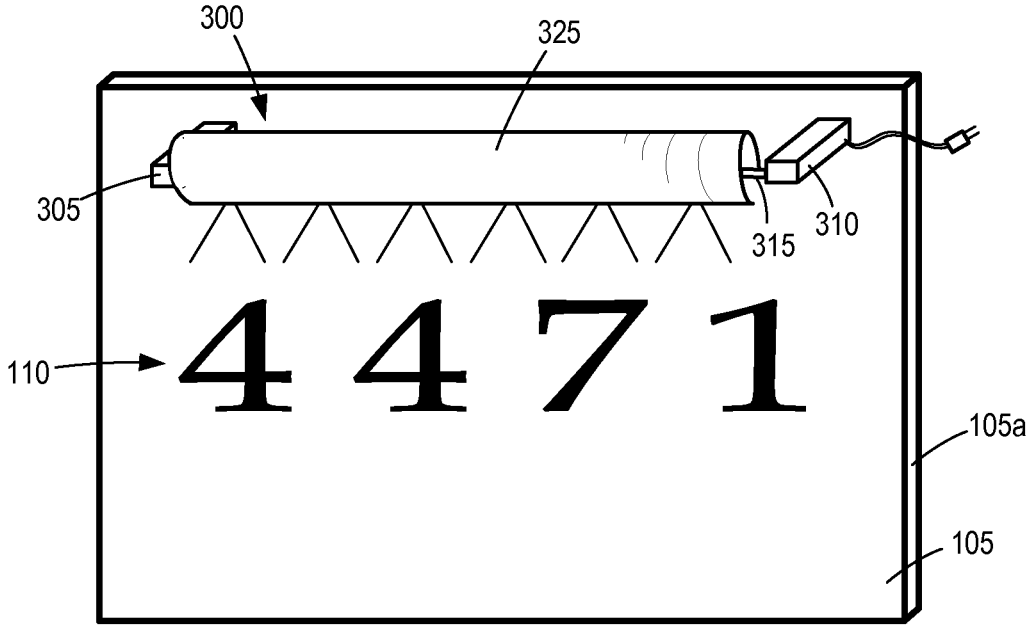
FIGS. 24 and 25 respectively show an overall perspective view a house lighting device and a side view of the house lighting device according to one alternative embodiment.
Figure 25:
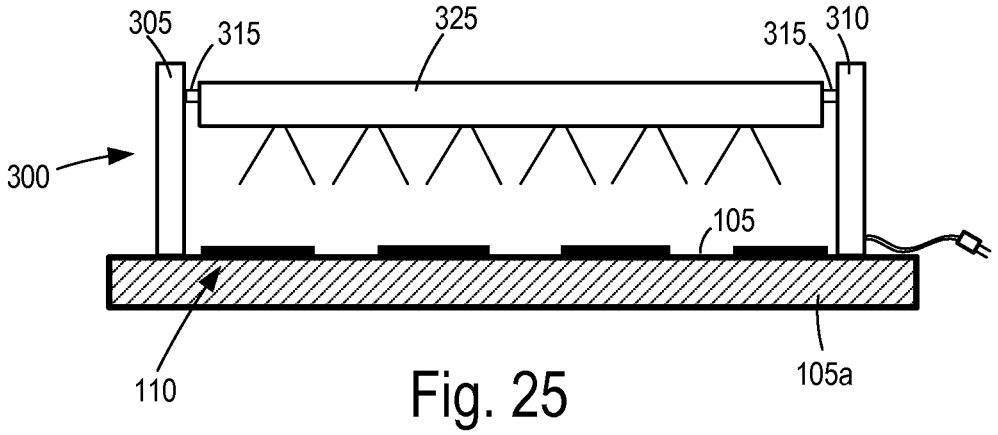

FIGS. 24 and 25 respectively show an overall perspective view a house lighting device 300 and a side view of the house lighting device according to an alternative embodiment of the present invention. House lighting device 300 is similar to house lighting devices 100 and 200 in that house lighting device 300 is configured to provide illumination for house numbers 110 as described above, but differs in the house lighting device 300 includes at least a first post 305 and may include a second post 310 that positions the light sources 135 above the house numbers.

The first post and the second post may be connected to surface 105 at first ends of the posts and may be oriented substantially transversely to surface 105. The first post and the second post can be connected to surface 105 and wall 105*a* by a variety of fasteners, such as screws, nails, clips, bolts, or other fasteners. In one embodiment, each of the first post and the second post include integrally formed fasteners, such as screws, that can be screwed into surface 105 and wall 105*a* by rotating the posts and the screws to engage the wall. In other embodiments, the first post and the second post include holes formed therein through which fasteners, such as screws, can be positioned to mount the first post and the second post to the surface and wall. In some embodiments, the bottom of each post includes a nut (e.g., integrally formed) that can receive a bolt from a back side of the post. Such configurations allow house lighting device 300 to be secured to a wall or a house number plaque from a back side of the wall or house number plaque where bolts passes from the back of the wall or house number plaque to the nuts of the posts. The foregoing described fasteners for securing house lighting device 300 is not exhaustive and other fasteners may be used for mounting the house lighting device to a wall or the like and these other fasters are included in the described embodiments of this patent.

In FIGS. 24 and 25 first post 305 and second post 310 are shows as having a bar shape with a substantially rectangular cross-sectional shape. However, the embodiments of house lighting device 300 are not limited to having posts of this shape. The post can have nearly any shape, such as having round cross-sections, tapered (e.g., finial shaped), round cross-sections and tapered, rectangular cross-sections and tapered, or other shapes.

House lighting device 300 may include a light bar 315 that includes light sources 135. Light bar 315 is attached to one or both of first post 305 and second post 310, and may be substantially transversely oriented with respect to the posts. Light bar 315 is electrically connected to one or both of the first and second posts for receiving electrical power. The light bar is substantially rigid and may be formed from a variety of materials, such as plastic, nylon, metals (e.g., aluminum, plated tin (e.g., chrome or nickel plated tin), or other material. In one embodiment, light bar 315 includes one of the LEDs strips 155 on which one or more LEDs may be positioned.

Figure 26:
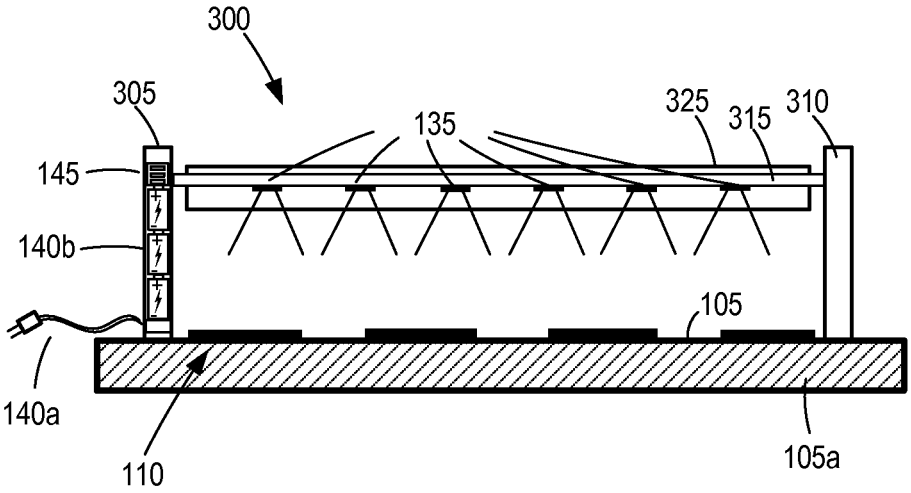
FIG. 26 is a cutaway view of the house lighting device shown in FIGS. 25 and 26.

FIG. 26 is a cutaway view of house lighting device 300. The cutaway view of house lighting device 300 shows the second power source 140*b* and circuit 145 positioned in first post 305. In some embodiments, second power source 140*b* is distributed in first post 305 and second post 310 (not shown). In other embodiments, the second power source is positioned in second post 310. The first power source 140*a* is coupled to one or both of the first post 305 and the second post 310. Light bar 315 includes electrical contacts for distributing electrical power from the first or second power source to light sources 135 on light bar 135.

Circuit 145 may be in the first post, the second post, or may be distributed between the two posts. One or both of the first and the second post may include light detectors and may include one more apertures or the like that allow light to reach the light detectors. One or both posts may also include a light pipe that pipes light from the surface of the post to the light detector. The light pipe may seal the aperture in which the light pipe is positioned from surface moisture to inhibit moisture from entering one or both of the posts while still providing light to the interior of the post. In some embodiments, the light detector is positioned on the surface of the post.

In one embodiment, a fluorescent light is connected to one or both of the first post and the second post, and one or both of the first post and the second post may include light sockets that are configured to hold the fluorescent light. The sockets may be provide electrical power to the fluorescent light from the first or the second power source. In this embodiment, house lighting device 300 may not include the light bar.

House light device 300 includes a reflector 325 that is connected to one or both of the first post and the second post, or is connected to light bar 315. Reflector 315 may be connected the first post, the second post, or the light bar with one or more brackets that hold the reflector away (e.g., about 1 centimeter to about 10 centimeters) from the light bar. The reflector is configured to reflect light generated by the light sources toward the house number. The reflector also blocks lights from travelling outward from the light sources so that generated light does not travel directly towards a viewers eyes thereby limiting discomfort from direct viewing of the light sources.

Reflector 315 can be formed from a variety of materials. For example, the reflector may be formed of metal coated plastic or nylon where the metal coating is esthetically pleasing and functions to reflect light toward the house numbers. The reflector may also be formed of metal, such as anodized aluminum, polished metal, such as polished brass, plated metal, such as chrome plated tin, nickel plated tin, or other materials. The first post, the second post, the light bar, and the reflector may all be fabricated from the same material or disparate materials. For example, each of these elements may be formed of chrome plated tin, nickel plated tin, stainless steal, or polished brass, so that the house lighting device has a generally uniform appearance that is functional and aesthetically pleasing.

Reflector 315 may have a variety of shapes. For example, as shown in FIGS. 24 and 25, the reflector has an open tube shape that partially surrounds light bar 315 where the opening in the open tube runs along a longitudinal direction of the reflector. The opening along the longitude of the reflector allows light from the light sources to exit the reflector and be directed toward the house numbers. The ends of the reflector may be open, as shown in FIGS. 24 and 25, or may be substantially closed with openings for the light bar to pass into the reflector. The embodiment of the reflector shown in FIGS. 24 and 25 has a substantially round cross-sectional shape. Reflector 315 may have other cross-sectional shapes, such as square, triangular (e.g., apex angle above the light sources and light bar), rectangular, ovoid, or other shapes. According to other example embodiments, reflector 315 may be substantially planar and may be in a slanted orientation (e.g., slanted outward from top to bottom) for reflecting light to the house numbers.

Figure 27:
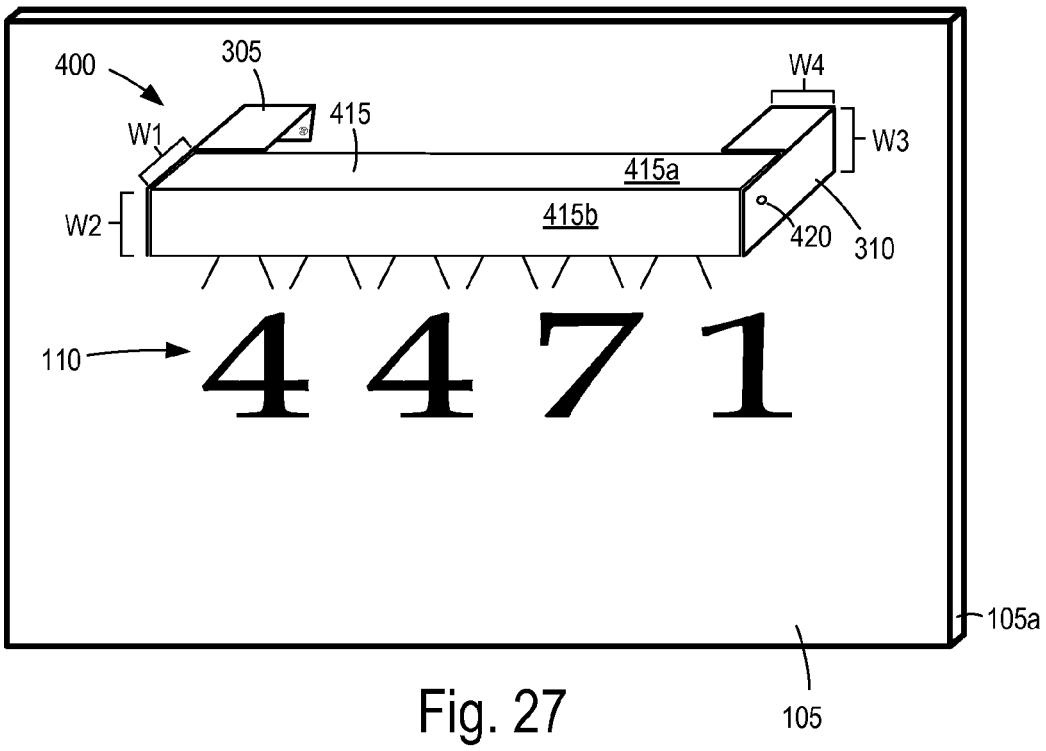
FIGS. 27 and 28 show two overall perspective views a house lighting device according to another alternative embodiment.
Figure 28:
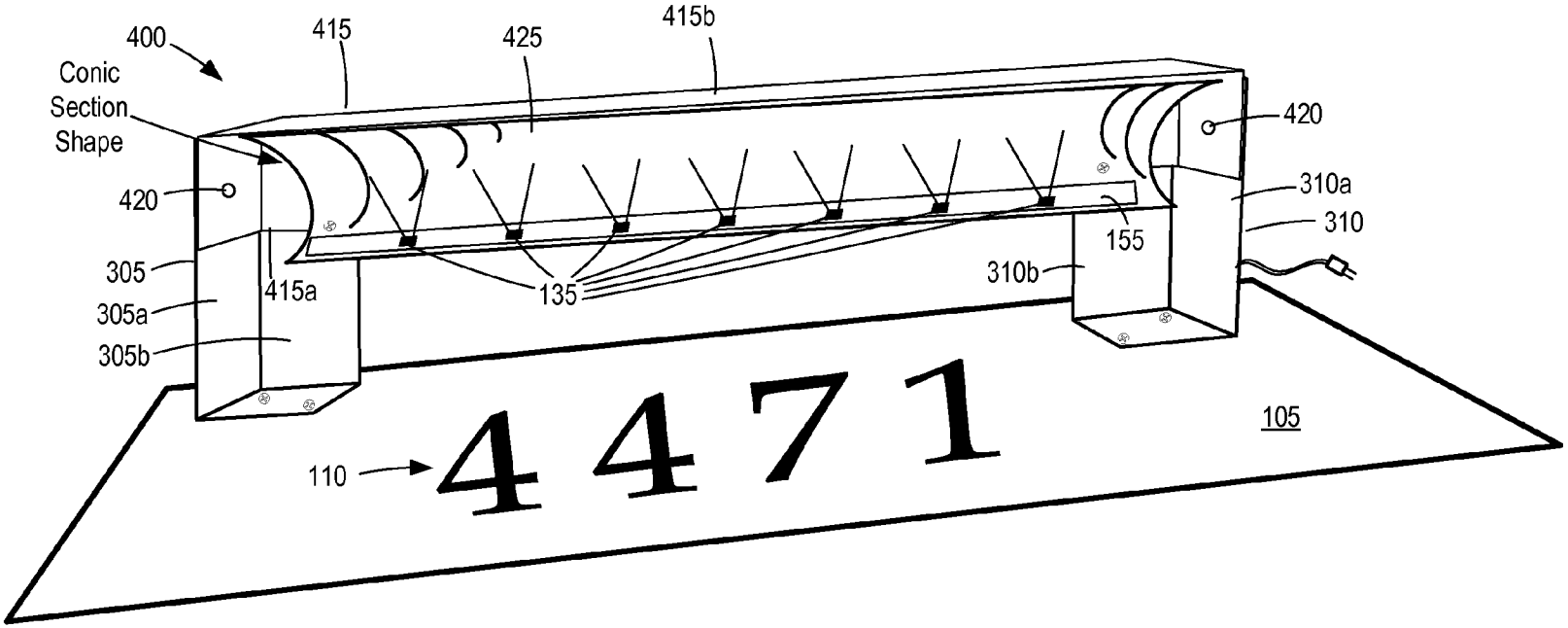

FIGS. 27 and 28 show overall perspective views a house lighting device 400 according to an alternative embodiment of the present invention. House lighting device 400 is similar to house lighting device 300 in that house lighting device 400 is configured to provide illumination for house number 110 as described above, but differs in that house lighting device 400 includes a light shade 415 that is configured to rotate with respect to first and second posts 305 and 310. Specifically, first and second posts 305 and 310 are rotationally coupled to light shade 415 via rotation fasteners 420. Rotation fasteners 420 may include one or more of a variety of fastener types such as rivets, nuts and bolts, or other fasteners. The rotational fasteners may have sufficient friction such that the light shade may be freely rotated by hand, and thereafter held in place in the new position by the rotation fasteners. Alternatively, the rotations fasteners may be configured to be loosened so that the rotatable shade can be rotated to a new position and then the rotation fasteners may be tightened to hold the rotatable shade in the new position.

Light shade 415 may include a top portion 415*a* and a front portion 415*b* where the top and the front portions may be substantially transverse with respect to each other. The widths (W1 and W2, respectively) of the top and the front portions may be substantially the same providing for the light shade to have a square cross-sectional appearance (e.g., as shown in FIG. 28), or the widths of these portions may be different providing for the light shade to have a rectangular cross-sectional appearance (e.g., as shown in FIG. 27).

First post 305 may have a side portion 305*a* and a back portions 305*b* that are substantially transverse with respect to each other, and second post 310 may similarly have a side portion 310*a* and a back portions 310 that are substantially transverse with respect to each other. The side and the back portions of each of the first and the second posts may have widths (W3 and W4) that are substantially similar to the widths of the top and front portions of the light shade to provide a square and balanced aesthetic, or that are different from the widths of the top and front portions of the light shade to provide a rectangular aesthetic. While the first and the second posts are described above and shown in FIGS. 27 and 28 as including two sides, the posts may each include one side, three sides, or four sides. In some embodiments, the posts have other shapes, such as round, pentagonal, tapered, or other shapes.

In one embodiment, light shade 415 includes a reflector 425 that is positioned in an inner portion of the light shade, for example, within the extent of front portion 415*a* and top portion 415*b*. The reflector may have a variety of shapes for directing light received from light sources 135 toward house number 110. For example, the reflector may be substantially planar, curved, or have other shapes. Curved reflector embodiments may have conic section shapes, such as a parabolic shape (as viewed from the ends of the reflector), or an elliptical shape (e.g., an open ellipse as viewed from the ends of the reflector), or a hyperbolic shape (e.g., one half of a full hyperbola as viewed from the ends of the reflecto). Curved reflector embodiments may alternatively have a paraboloid shape (e.g., open on one side), a heyperabaloid shape (e.g., open on one side), an ellipsoid shape (e.g., open on one side), a combination of shapes, a capricious shape, or other shape.

In some embodiments, light sources 135 are oriented to substantially face the reflector and direct generated light toward the reflector. For example, the light sources might be located at focal points (e.g., a line of focal points for an elongated reflector as shown in FIG. 28) of a reflector that is parabolic, elliptical, or hyperbolic so that light emitted by the light sources is directed from the light sources toward the reflector and then reflected generally toward the house number with known reflectance properties. For example, a reflector this is parabolic provides that a relatively large percentage of light generated by the light sources is directed in substantially parallels rays toward the house number and a relatively low percentage of the light is directed elsewhere.

According to another example, a reflector that is elliptical provides that a relatively large percentage of light generated by the light sources (e.g., located substantially along a line a first focal points) is directed from the reflector toward second focal points (a line of focal points) of the reflector. House number 110 may be positioned adjacent (e.g., inside or outside) to the second focal points or at the second focal points so that the reflected light spreads across the house number in a known manner. For example, the reflected light from a elliptical reflector can have a substantially rectangular wave front where the size of the rectangular wave front can approximately match the rectangular footprint of the house number if the house number is positioned inside or outside of the second focal points. A hyperbolic shaped reflector can be similarly configured to provide a rectangular wave front to illuminate the house numbers.

The reflector may be connected to the light shade by a variety of fasteners, such as screws, nuts and bolts, welds, magnets, or other fasteners. The reflector may also be hinge attached to the light shade so that the reflector may be hinge rotated with respect to the light shade to provide access to the space between the reflector and the light shade.

In some embodiments, the light sources are connected to one or more structures, such as brackets, that position the light sources at a distance from the reflector. For example, if the reflector is parabolic, the brackets may position the light sources at the focal points of the reflector where the focal points may be along a longitude of the reflector. The brackets that hold the light sources may connect to the reflector, to the light shade, to the posts, or a combination of these elements.

In one embodiment the second power source 140*b*, control circuit 145, or both are positioned behind a back side of the reflector (i.e., between the reflector and the light shade) and the first power source may be connected to the second power source via the light shade or via one or the posts. If the second power source includes a number of batteries, the batteries may be linearly arranged behind the reflector along a length (i.e., a longitude) of the reflector. In some embodiments, the second power source may be located in one or both of the first post and the second post, for example, if the posts are substantially closed. The reflector can be configured to be removed from the light shade so that access to the batteries or the circuit is provided. The batteries may be need to accessed and changed if the batteries run down and cannot hold an adequate charge.

This description of the invention has been presented for the purposes of illustration and description. It is not intended to be exhaustive or to limit the invention to the precise form described, and many modifications and variations are possible in light of the teaching above. The implementations were chosen and described in order to best explain the principles of the invention and its practical applications. This description will enable others skilled in the art to best utilize and practice the invention in various implementations and with various modifications as are suited to a particular use. The scope of the invention is defined by the following claims.

The invention claimed is:

1. A house number light comprising:

a first post having a first end and a second end, wherein the first end is adapted to be mounted to a surface to support the first post and the second end is distal from the first end;

a light bar, electrically and mechanically coupled to the second end of the first post, comprising a light source;

a light shade mechanically coupled to the second end of the first post or the light bar, wherein the first post comprises a first side between the first and the second end, the first end comprises a flat plate, which extends under the light shade, such that when the flat plate is mounted to the surface to support the first post, the flat plate is positioned between the light shade and the surface and the flat plate does not extend to a position that is not between the light shade and the surface, the light shade is formed of a material that is opaque, the light shade comprises a first surface, a portion of the first surface faces towards the first end of the first post and the surface, the first surface of the light shade is reflective and has a substantially parabolic shape that is adapted to reflect light emitted from the light source substantially towards the surface and substantially focus the light emitted from the light source in a substantially rectangular-shaped wave front, the light shade comprises a second surface that is an opposite surface of the light shade relative to the first surface of the light shade, a portion of the second surface of the light shade faces substantially away from the first post and the surface, and the light shade is adapted to block light emitted from the light source from traveling in a direction away from first post and the surface;

first power source coupled to the first post;

a second power source inside the first post; and a control circuit connected between the first power source and the light sources and connected between the second power source and the light sources, wherein:

the control circuit is located within the first post;

the control circuit is configured to electrically couple one of the first and the second power sources to the light sources at a time, if the first power source is electrically coupled to the light sources, electrical energy is provided by the first power source passes through the control circuit to the light sources and the second power source is electrically uncoupled from the light sources, and if the second power source is electrically coupled to the light sources, electrical energy is provided by the second power source passes through the control circuit to the light sources and the first power source is electrically uncoupled from the light sources.

2. The house number light of claim 1, wherein the control circuit comprises:

a first switch connected between the first power source and the light sources, a second switch connected between the second power source and the light sources, and an ambient light detector coupled to the first and the second switches and configured to switch the first switch and the second switch.

3. The house number light of claim 2, wherein the ambient light detector is configured to open the first and the second switches if the light detector detects an ambient light intensity above a threshold light level intensity.

4. The house number light of claim 1, wherein the second power source includes a set of rechargeable batteries.

5. The house number light of claim 1, wherein the control circuit comprises a battery charging circuit, a switch coupled to the second power source, and a light emitting diode (LED) driver connected between the first power source and the light sources and connected between the first power source and the battery charging circuit.

6. The house number light of claim 5, wherein the LED driver comprises:

a first diode (D1) is arranged in series electrically with the first and the second power sources;

a first resistor (R1) is arranged in series with the first and the second power sources and is electronically positioned between the D1 and the second power source;

a second resistor (R2) is arranged in series with the light source, the first power source, and the D1; and a second diode (D2) is arranged in parallel with the first power source, the second power source, and the light source, wherein the D1 is electronically positioned between the R1 and the first power source, and the R2 is electrically positioned between the D1 and the light sources.

7. The house number light of claim 1, further comprising a second post mechanically coupled to the light bar.

8. The house number light of claim 1, wherein a focus of the parabolic shape has a first shape that is substantially linear, the light source has a second shape that is substantially linearly, the substantially linear shape of the light source is parallel with the substantially linear focus of the parabolic shape, and the light source is located substantially along the focus of the parabolic shape.

9. The house number light of claim 1 wherein the second power source is positioned between the control circuit and the flat plate in the central opening formed in the first post.

10. The house number light of claim 1 wherein the light shade does not extend laterally beyond the flat plate at a side of the house number light.

11. A house number light comprising:

a first post having a first end and a second end, wherein the first end is adapted to be mounted to a surface to support the first post and the second end is distal from the first end;

a light bar, mechanically coupled to the second end of the first post, comprising a light source;

a light shade mechanically coupled to the second end of the first post or the light bar, wherein the first post comprises a first side between the first and the second end, the first end comprises a flat plate, which extends under the light shade, such that when the flat plate is mounted to the surface to support the first post, the flat plate is positioned between the light shade and the surface and the flat plate does not extend to a position that is not between the light shade and the surface, and the light shade does not extend laterally beyond the flat plate at a side of the house number light, the light shade is formed of a material that is opaque, the light shade comprises a first surface, a portion of the first surface faces towards the first end of the first post and the surface, the first surface of the light shade is reflective and has a substantially conic section shape that is adapted to reflect light emitted from the light source substantially towards the surface and substantially focus the light emitted from the light source in a wave front that has a substantially rectangular-shape, the light shade comprises a second surface that is an opposite surface of the light shade relative to the first surface of the light shade, a portion of the second surface of the light shade faces substantially away from the first post and the surface, and the light shade is adapted to block light emitted from the light source from traveling in a direction away from first post and the surface;

a first power source coupled to the light source;

a second power source coupled to the light source, wherein the second power source is located inside a central opening formed in the first post and is electrically coupled to the light source; and a control circuit, located inside the central opening formed in the first post, connected between the first power source and the light sources and connected between the second power source and the light sources, wherein:

the control circuit is configured to electrically couple one of the first and the second power sources to the light sources at a time, if the first power source is electrically coupled to the light sources, electrical energy is provided by the first power source passes through the control circuit to the light sources and the second power source is electrically uncoupled from the light sources, and if the second power source is electrically coupled to the light sources, electrical energy is provided by the second power source passes through the control circuit to the light sources and the first power source is electrically uncoupled from the light sources.

12. The house number light of claim 11, wherein the substantially conic section shape of the first surface of the light shade is a substantially parabolic shape.

13. The house number light of claim 12, wherein a focus of the parabolic shape has a first shape that is substantially linear, the light source has a second shape that is substantially linearly, the substantially linear shape of the light source is substantially parallel with the substantially linear focus of the conic section shape, and the light source is located substantially along the focus of the parabolic shape.

14. The house number light of claim 11, wherein the second power source includes a set of rechargeable batteries.

15. The house number light of claim 11, further comprising a second post, wherein the light shade is rotationally coupled to the first post and the second post.

16. The house number light of claim 11, the light shade, the first post, and the second post have substantially rectangular shapes.

17. The house number light of claim 11, wherein a focus of the conic section shape has a first shape that is substantially linear, the light source has a second shape that is substantially linearly, the substantially linear shape of the light source is parallel with the substantially linear focus of the conic section shape, and the light source is located substantially along the focus of the conic section shape.

18. The house number light of claim 11 wherein the second power source is positioned between the control circuit and the flat plate in the central opening formed in the first post.

19. A light comprising:

a first post having a first end and a second end, wherein the first end is adapted to be mounted to a surface to support the first post and the second end is distal from the first end;

a light bar, mechanically coupled to the second end of the first post, comprising a light source;

a light shade mechanically coupled to the second end of the first post or the light bar, wherein the first post comprises a first side between the first and the second end, the first end comprises a flat plate, which extends under the light shade, such that when the flat plate is mounted to the surface to support the first post, the flat plate is positioned between the light shade and the surface and the flat plate does not extend to a position that is not between the light shade and the surface, the light shade is formed of a material that is opaque, the light shade comprises a first surface, a portion of the first surface faces towards the first end of the first post and the surface, the first surface of the light shade is reflective and has a substantially parabolic shape that is adapted to reflect light emitted from the light source substantially towards the surface and substantially focus the light emitted from the light source in a substantially rectangular-shaped wave front, the light shade comprises a second surface that is an opposite surface of the light shade relative to the first surface of the light shade, a portion of the second surface of the light shade faces substantially away from the first post and the surface, and the light shade is adapted to block light emitted from the light source from traveling in a direction away from first post and the surface;

first power source coupled to the first post;

a second power source inside the first post; and a control circuit connected between the first power source and the light sources and connected between the second power source and the light sources, wherein:

the control circuit is located within the first post;

the control circuit is configured to electrically couple one of the first and the second power sources to the light sources at a time, if the first power source is electrically coupled to the light sources, electrical energy is provided by the first power source passes through the control circuit to the light sources and the second power source is electrically uncoupled from the light sources, and if the second power source is electrically coupled to the light sources, electrical energy is provided by the second power source passes through the control circuit to the light sources and the first power source is electrically uncoupled from the light sources.

20. The light of claim 19, wherein the second power source includes a set of rechargeable batteries.

* * * * *